US011134756B2

(12) United States Patent
Kayahara et al.

(10) Patent No.: US 11,134,756 B2
(45) Date of Patent: Oct. 5, 2021

(54) WATERPROOF SLIDE FASTENER

(71) Applicant: YKK Corporation, Tokyo (JP)

(72) Inventors: Masanori Kayahara, Toyama (JP); Mineto Terada, Toyama (JP); Ryo Mikuma, Toyama (JP); Kazuya Taniguchi, Toyama (JP); Yuki Sakagami, Toyama (JP)

(73) Assignee: YKK Corporation, Tokyo (JP)

( * ) Notice: Subject to any disclaimer, the term of this patent is extended or adjusted under 35 U.S.C. 154(b) by 230 days.

(21) Appl. No.: 16/340,209

(22) PCT Filed: Oct. 11, 2016

(86) PCT No.: PCT/JP2016/080133
§ 371 (c)(1),
(2) Date: Apr. 8, 2019

(87) PCT Pub. No.: WO2018/069971
PCT Pub. Date: Apr. 19, 2018

(65) Prior Publication Data
US 2020/0037711 A1 Feb. 6, 2020

(51) Int. Cl.
*A44B 19/32* (2006.01)

(52) U.S. Cl.
CPC ..... *A44B 19/32* (2013.01)

(58) Field of Classification Search
CPC ..... A44B 19/32; A44B 19/36; Y10T 24/2514
See application file for complete search history.

(56) References Cited

U.S. PATENT DOCUMENTS 2,800,699 A * 7/1957 Armstrong ..... A44B 19/36 24/387
3,668,745 A * 6/1972 Krupp ..... A44B 19/32 24/389

(Continued)

FOREIGN PATENT DOCUMENTS

CN 1939180 A 4/2007
JP 103411/1988 A1 7/1988

(Continued)

OTHER PUBLICATIONS

International Search Report, PCT Patent Application No. PCT/JP2016/080133, dated Dec. 20, 2016.

(Continued)

*Primary Examiner* — Robert Sandy
*Assistant Examiner* — Louis A Mercado
(74) *Attorney, Agent, or Firm* — Kilpatrick Townsend & Stockton LLP

(57) ABSTRACT

The waterproof slide fastener includes a slider and a slider stopper member. A flange portion of the slider includes a linear portion extending linearly from a rear mouth and a curved portion extending to curve outward from an end part of the linear portion. The slider stopper member includes an insertion base portion disposed across right and left waterproof tapes, right and left insertion leg portions extending from the insertion base portion toward element rows, and flange press contact portions disposed on outer side surfaces of the respective insertion leg portions, wherein the flange press contact portion includes a press contact curved portion and a press contact straight portion extending linearly from a rear end part of the press contact curved portion. Thereby, even when the slider is held at a sliding limit vicinity position away from a sliding limit position, watertightness can be exerted.

13 Claims, 9 Drawing Sheets

(56) References Cited

U.S. PATENT DOCUMENTS

| | | | | |
|---|---|---|---|---|
| 4,524,493 | A * | 6/1985 | Inamura | A44B 19/36 24/389 |
| 4,604,775 | A * | 8/1986 | Kusayama | A44B 19/301 24/384 |
| 4,825,514 | A | 5/1989 | Akeno | |
| 6,497,014 | B2 * | 12/2002 | Neugebauer | A44B 19/32 24/389 |
| 7,565,722 | B2 * | 7/2009 | Kusayama | A44B 19/386 24/388 |
| 7,591,051 | B2 * | 9/2009 | Kusayama | A44B 19/32 24/387 |
| 8,104,147 | B2 * | 1/2012 | Peano | A44B 19/26 24/388 |

FOREIGN PATENT DOCUMENTS

| | | | |
|---|---|---|---|
| JP | 2007-089898 | A1 | 4/2007 |
| WO | 2011-004500 | A1 | 1/2011 |
| WO | 2012-176486 | A1 | 12/2012 |
| WO | 2013-114529 | A1 | 8/2013 |
| WO | 2013-136473 | A1 | 9/2013 |
| WO | 2016-027310 | A1 | 2/2016 |

OTHER PUBLICATIONS

Office Action, Chinese Patent Application No. 201680089794.0, dated Jan. 12, 2021, 17 pages.

* cited by examiner

WATERPROOF SLIDE FASTENER

TECHNICAL FIELD

The invention relates to a waterproof slide fastener, particularly to the one having a slider stopper member provided with waterproof structure for preventing entry of a liquid such as water.

BACKGROUND ART

When doing marine sports, waterproof suits (protection suits) provided with waterproof property are often used for cold protection or injury prevention measures. As waterproof suits, dry suits not allowing water to enter inside the suits and wet suits allowing water to enter inside the suits are known. The dry suits, for example, are often used in harsh environments such as extremely cold waters and polluted waters.

Such a waterproof suit is provided with an open and close part or an open mouth part for opening and closing when putting on and off the waterproof suit, and a slide fastener (hereinafter referred to as a waterproof slide fastener) having waterproof property is attached to the open and close part or the open mouth part.

In general, a waterproof slide fastener has a right and left pair of fastener stringers in which element rows are formed on waterproof tapes having a waterproof layer made of an elastomer, and a slider capable of sliding along the element rows. In such a waterproof slide fastener, right and left element rows are coupled with each other such that facing side edge parts of the right and left waterproof tapes are in close contact with each other, which prevents water from entering into the tape back surface side from the tape top surface side (or into the tape top surface side from the tape back surface side) via a gap between the right and left waterproof tapes.

At both end parts of the element rows in the waterproof slide fastener, a slider stopper member (also referred to as a stopper) for stopping the sliding of the slider and defining the sliding range of the slider, and a separable rear end stop formed of an insert pin, a box pin and a box body are disposed adjacently to the element rows. Here, in a case when the stopper members are disposed at both end parts of the element rows, the slider stopper member (stopper) on the fastener closing direction side where the slider comes in contact with when the right and left element rows are completely closed is referred to as a first stopper member (also referred to as an upper stopper), and the slider stopper member on the fastener opening side where the slider comes in contact with when the right and left element rows are completely opened is referred to as a second stopper member (also referred to as a lower stopper).

In JP 2007-089898 A (Patent Document 1), for example, a first stopper member disposed on the closing direction side of a waterproof slide fastener is disclosed.

As illustrated in FIG. 8 and FIG. 9, the first stopper member 80 described in the Patent Document 1 is disposed adjacently to one end parts of right and left element rows, and disposed across right and left waterproof tapes 71. The first stopper member 80 is formed to be bulged to a tape top surface (first tape surface) side and to a tape back surface (second tape surface) side of the waterproof tape 71.

The first stopper member 80 of the Patent Document 1 has a stopper portion 81 disposed at a front end part of the first stopper member 80 and having a curved shape in which a thick dimension in the tape top and back direction is larger than an interval between upper and lower blades of a slider 72, and a slider insertion portion 82 which extends from the stopper member 81 toward the element row side and which is inserted between the upper and lower blades (into the element guide path) of the slider 72.

The slider insertion portion 82 of the first stopper member 80 is formed to be an inverted U-shape in a top view when the slider insertion portion 82 is viewed from above. The slider insertion portion 82 includes an insertion base portion 83 disposed across the right and left waterproof tapes 71 and right and left insertion leg portions 84, 85 extending from the insertion base portion 83 toward the element rows.

In the slider insertion portion 82, when the slider insertion portion 82 is inserted between the upper and lower blades of the slider 72, an accommodating space portion 88 surrounded by the insertion base portion 83 and the right and left insertion leg portions 84, 85 and accommodating a guide column 73 of the slider 72 is formed.

At outer side edge parts of tip end parts (rear end parts) in the right and left insertion leg portions 84, 85, press contact bulged portions 86 which are in press contact with the right and left flange portions 74 of the slider 72 are respectively disposed. Each of the right and left press contact bulged portions 86 is formed to be bulged further toward an outside of outer side end edges of the insertion leg portions 84, 85 and also bulged to an upper and lower direction (tape top and back direction) compared with upper surfaces and lower surfaces of the insertion leg portions 84, 85.

At an inner side edge part of the insertion base portion 83 and an inner side edge part of the right and left insertion leg portions 84, 85 in the slider insertion portion 82, a protruded rib portion 87 protruding in the upper and lower directions so as to surround the accommodating space portion 88 is formed. The protruded rib portions 87 are respectively provided protrudingly on the upper surface and the lower surface of the slider insertion portion 82, and are in close contact with the inner surface of the upper blade and the inner surface of the lower blade of the slider 72, respectively, when the slider insertion portion 82 is inserted into the slider 72.

In the waterproof slide fastener 70 having the first stopper member 80 of the Patent Document 1, the slider 72 is slid in the closing direction so that the right and left element rows are coupled. Thereby, the facing side edge parts of the right and left waterproof tapes 71 can be in close contact with each other. Accordingly, it is possible to ensure watertightness between the right and left waterproof tapes 71, and to prevent a liquid such as water from entering into the tape back surface side from the tape top surface side (or the reverse direction) via the gap between the right and left waterproof tapes 71.

Further, the slider 72 is slid and held at a sliding limit position on the closing direction side, thereby, the guide column 73 of the slider 72 passes between the tip end parts of the right and left insertion leg portions 84, 85 in the first stopper member 80, and is accommodated into the accommodating space portion 88 of the first stopper member 80, as shown in FIG. 9. At the same time, the upper and lower protruded rib portions 87 disposed on the first stopper member 80 are in close contact with the inner surface of the upper blade and the inner surface of the lower blade of the slider 72, respectively.

At this time, outer side surfaces of the right and left press contact bulged portions 86 in the first stopper member 80 come in contact with the right and left flange portions 74 of the slider 72, thereby the right and left insertion leg portions 84, 85 are pressed toward an inside. Therefore, the tip end parts of the right and left insertion leg portions 84, 85 are in press contact with each other, and the right and left tip end parts of the protruded rib portion 87 are in press contact with each other. As a result, an inside region and an outside region of the protruded rib portion 87 are blocked by the protruded rib portion 87, thereby, a liquid such as water can be prevented from entering beyond the protruded rib portion 87.

Accordingly, in the waterproof slide fastener 70 having the first stopper member 80 as mentioned above, the slider 72 is moved and held at the sliding limit position (front end position) on the closing direction side, which makes it possible to ensure watertightness for preventing water from entering not only in a part in which the right and left element rows are disposed but also at the fastener front end part in which the first stopper member 80 of the waterproof slide fastener 70 is disposed.

PRIOR ART DOCUMENT

Patent Document

Patent Document 1: JP 2007-089898 A

SUMMARY OF INVENTION

Problems to be Solved by the Invention

In a case of the waterproof slide fastener 70 provided with the first stopper member 80 of the Patent Document 1 as above, for example, the slider 72 is slid so as to come in contact with the first stopper member 80 and held at the sliding limit position on the closing direction side. Thereby, the accommodating space portion 88 of the first stopper member 80 in which the guide column 73 of the slider 72 is accommodated is sealed to have waterproof property (watertightness) as described above.

In the meantime, in such a waterproof slide fastener 70, when the slider 72 is slid to the sliding limit position on the closing side, the protruded rib portions 87 of the first stopper member 80 are inserted into the element guide path of the slider 72 to be slidingly contact with the inner surfaces of the upper blade and the lower blade of the slider 72. Therefore, since sliding friction of the slider 72 becomes larger when the protruded rib portions 87 are inserted into the slider 72, the sliding operation may be felt heavy in some cases. As a result, it is conceivable that the slider 72 is stopped unintentionally at an intermediate position in the first stopper member 80 without being sufficiently slid to the sliding limit position on the closing direction side.

When the slider 72 is held at the intermediate position in the first stopper member 80 as above, the right and left press contact bulged portions 86 of the first stopper member 80 are not sufficiently in contact with the right and left flange portions 74 of the slider 72, therefore, a sealed state of the accommodating space portion 88 is not formed. As a result, watertightness originally provided with the waterproof slide fastener 70 cannot be exerted properly.

Further, although in a state that the slider 72 is held at the sliding limit position on the closing side to exert watertightness of the waterproof slide fastener 70, the position of the slider 72 may be shifted from the sliding limit position to the element row side by unexpected movement of the slider 72 with some momentum, for example. As a result, watertightness of the waterproof slide fastener 70 cannot be maintained, and therefore water may be allowed to flow into the waterproof suit.

The present invention has been made in view of the above-described conventional problems. The specific object is to provide a waterproof slide fastener with improved reliability of waterproof function which is formed to be capable of properly exerting watertightness even when the slider is held at a position slightly inwardly displaced from a predetermined sliding limit position determined by the stopper member.

Means for Solving the Problems

In order to achieve the above object, the waterproof slide fastener provided by the present invention, as a basic structure, at least includes a right and left pair of fastener stringers in which element rows are provided at tape side edge parts of the waterproof tapes, a slider sliding along the element rows, and a slider stopper member disposed adjacently to end parts of the element rows on a closing direction side. The waterproof slide fastener includes the slider including an upper blade, a lower blade, a guide column connecting the upper blade and the lower blade, and flange portions disposed at right and left side edge parts of the upper blade and the lower blade and having a straight portion extending linearly along a slider sliding direction from a rear mouth of the slider and a curved portion extending to curve outward from an end part of the straight portion, and the slider stopper member including an insertion base portion disposed across the right and left waterproof tapes and inserted between the upper blade and the lower blade of the slider, right and left insertion leg portions extending toward the element rows from the insertion base portion, right and left flange press contact portions disposed on outer side surfaces of tip end parts of the insertion leg portions and coming in press contact with the flange portions, and blade close contact portions in close contact with inner surfaces of the upper blade and the lower blade. As the most principal structure of the waterproof slide fastener, the right and left flange press contact portions respectively include a press contact curved portion curving corresponding to the curved portion of the flange portions in the slider and a press contact straight portion extending linearly along the slider sliding direction from a rear mouth side end part of the press contact curved portion toward the rear mouth.

In such a waterproof slide fastener of the present invention, it is preferable that in a state that the slider is held at a sliding limit position on a closing direction side, a center press contact part in which the right and left insertion leg portions of the stopper member are in press contact with each other and right and left tip end parts of the blade close contact portions are in press contact with each other, and right and left outer side press contact parts in which the flange press contact portions of the stopper member are in press contact with the flange portions are formed, and the center press contact part and the right and left outer side press contact parts include rear press contact regions extending to a rear mouth side of the slider from a boundary position between the straight portion and the curved portion of the flange portion in a slider sliding direction.

Further, another waterproof slide fastener provided by the present invention, as a basic structure, at least includes a right and left pair of fastener stringers in which element rows are provided at tape side edge parts of the waterproof tapes, a slider sliding along the element rows, and a slider stopper member disposed adjacently to end parts of the element rows on a closing direction side. The waterproof slide fastener includes the slider including an upper blade, a lower blade, a guide column connecting the upper blade and the lower blade, and flange portions disposed at right and left side edge parts of the upper blade and the lower blade, the slider stopper member includes an insertion base portion disposed across the right and left waterproof tapes and inserted between the upper blade and the lower blade of the slider, right and left insertion leg portions extending toward the element rows from the insertion base portion, right and left flange press contact portions disposed on outer side surfaces of tip end parts of the insertion leg portions and in press contact with the flange portions, and blade close contact portions in close contact with inner surfaces of the upper blade and the lower blade. As the most principal structure of the waterproof slide fastener, in a state that the slider is held at a sliding limit position on a closing direction side, a center press contact part in which the right and left insertion leg portions of the stopper member are in press contact with each other and right and left tip end parts of the blade close contact portions are in press contact with each other is formed, and even in a state that the slider is moved from the sliding limit position, the guide column of the slider is separated from the insertion base portion of the slider stopper member, and the blade close contact portions are held at a position of being in close contact with the upper blade and the lower blade of the slider, the center press contact part is maintained.

In such a waterproof slide fastener of the present invention, it is preferable that the flange portion includes a straight portion extending linearly along the slider sliding direction from a rear mouth of the slider and a curved portion extending to curve outward from an end part of the straight portion, the right and left flange press contact portions respectively include a press contact curved portion curving corresponding to the curved portion of the flange portions in the slider and a press contact straight portion extending linearly along the slider sliding direction from a rear mouth side end part of the press contact curved portion toward the rear mouth. In a state that the slider is held at the sliding limit position, right and left outer side press contact parts in which the flange press contact portions of the stopper member are in press contact with the flange portions are formed, and the center press contact part and the right and left outer side press contact parts include rear press contact regions extending to a rear mouth side of the slider from a boundary position between the straight portion and the curved portion of the flange portion in a slider sliding direction.

In the waterproof slide fastener of the above-described present invention, it is preferable that a length dimension in a slider sliding direction of the rear press contact region in the center press contact part and a length dimension in a slider sliding direction of the rear press contact region in at least one of the right and left outer side press contact parts are set to be smaller than a length dimension of the straight portion in the flange portion in a slider sliding direction.

Further, it is preferable that in a state that the slider is held at a sliding limit position on a closing direction side, a movement allowing gap is formed between a peripheral surface on the rear mouth side end part of the guide column in the slider and inner peripheral surfaces of the insertion leg portions disposed behind the peripheral surface on the rear mouth side end part, length dimensions in a slider sliding direction of each of the rear press contact regions in the center press contact part and the right and left outer side press contact parts are set to be larger than a minimum length dimension of the movement allowing gap in a slider sliding direction.

Further, it is preferable that the length dimension of the rear press contact region in the center press contact part and the length dimension of the rear press contact region in one of the right and left outer side press contact parts are set to be smaller than the length dimension of the rear press contact region in the other of right and left outer side press contact parts.

Furthermore, it is preferable that a difference between the length dimension of the rear press contact region in the center press contact part and the length dimension of the straight portion in the flange portion, and a difference between the length dimension of the rear press contact region in one of the right and left outer side press contact parts and the length dimension of the straight portion in the flange portion is set to be larger than ⅓ of a maximum length dimension of a fastener element in the element rows in a slider sliding direction.

Further in the waterproof slide fastener, it is preferable that the blade close contact portions are formed of protruded rib portions protruding continuously on both top and back surfaces of the insertion base portion and the right and left insertion leg portions at inner side edge parts, and when a cross section orthogonal to a tape top and back direction is viewed in a state that the right and left outer side press contact parts are in press contact with the flange portions, the protruded rib portions surround the guide column of the slider and keep an inside region of the protruded rib portions in a sealed state.

Effects of the Invention

The waterproof slide fastener according to the present invention includes at least a right and left pair of fastener stringers in which element rows are formed at tape side edge parts of the waterproof tapes provided with a waterproof layer on at least one tape surface, a slider, and a slider stopper member (first stopper member) disposed adjacently to a closing direction-side end part of the element row. A flange portion of the slider is provided with at least a straight portion extending linearly along a slider sliding direction from a rear mouth of the slider to a boundary position and a curved portion extending to curve outward from the boundary position. In this case, the slider sliding direction is the same direction as a tape length direction of the waterproof tape.

The stopper member of the present invention includes an insertion base portion disposed across the right and left waterproof tapes, right and left insertion leg portions extending from the insertion base portion toward the element rows, right and left flange press contact portions disposed at a tip end outer side edge part of each insertion leg portion and are in press contact with the flange portions of the slider, and blade close contact portions which are in close contact with inner surfaces of the upper blade and the lower blade. The right and left flange press contact portions of the stopper member respectively include a press contact curved portion curving corresponding to the curved portion of the flange portion of the slider and a press contact straight portion extending linearly along the slider sliding direction from the rear mouth-side end part of the press contact curved portion.

The right and left flange press contact portions of the stopper member include the press contact straight portions extending linearly at the rear end part thereof as above. Therefore, even when the slider is held at the sliding limit position on the closing direction side (hereinafter, briefly described as a sliding limit position on the closing side), and the slider is held at a position within a predetermined range slightly away inward from the sliding limit position on the closing side (hereinafter, referred to as a sliding limit vicinity position), it is possible to stably maintain the state that the right and left flange press contact portions of the stopper member press the right and left insertion leg portions of the stopper member toward an inside by coming in press contact with the straight portions of the flange portions of the slider, and the state that the right and left insertion leg portions are in press contact with each other by the press force and the right and left tip end parts of the blade close contact portions are in press contact with each other.

In the present invention, even when the slider is held at the sliding limit vicinity position as above, it is possible to ensure the state that the stopper member seals the accommodating space portion accommodating the guide column of the slider. Therefore, watertightness can be properly exerted at the fastener end part of the waterproof slide fastener on the closing direction side on which the stopper member is disposed. Accordingly, in the waterproof slide fastener of the present invention, it is possible to improve reliability of the waterproof function compared to the conventional ones.

Moreover, the waterproof slide fastener of the present invention is excellent in the sealing property between the right and left fastener stringers and the sealing property in the accommodating space portion of the stopper member when the slider is held at the sliding limit position or the sliding limit vicinity position on the closing side. Therefore, not only watertightness to prevent intrusion of liquid but also airtightness to prevent invasion of gas can also be exerted.

In such a waterproof slide fastener of the present invention, in a state that the slider is held at the sliding limit position on the closing side, a center press contact part in which the right and left insertion leg portions of the stopper member are in press contact with each other and right and left tip end parts of the blade close contact portions are in press contact with each other, and right and left outer side press contact parts in which the flange press contact portions of the stopper member are in press contact with the flange portions are formed. The center press contact part and the right and left outer side press contact parts include rear press contact regions extending toward a rear mouth side of the slider from a boundary position between the straight portions and the curved portions of the flange portions in the slider sliding direction.

According to the waterproof slide fastener of the present invention having such a configuration, even when the slider is held at the sliding limit vicinity position slightly away inward from the sliding limit position on the closing side, the above-described center contact part and right and left outside contact parts respectively have the rear press contact region, so that the center press contact part and the right and left outer side press contact parts are maintained. Accordingly, since the sealed state of the accommodating space portion can be maintained even at the sliding limit vicinity position, it is possible to stably exert favorable watertightness and airtightness of the waterproof slide fastener.

On the other hand, another waterproof slide fastener according to the present invention includes at least a right and left pair of fastener stringers in which element rows are formed at tape side edge parts of waterproof tapes provided with a waterproof layer on at least one tape surface, a slider, and a slider stopper member (first stopper member) disposed adjacently to a closing direction-side end part of the element rows. The slider stopper member includes an insertion base portion disposed across the right and left waterproof tapes, right and left insertion leg portions extending from the insertion base portion toward the element rows, right and left flange press contact portions which are disposed at a tip end outer side edge part of each insertion leg portion and are in press contact with the flange portions of the slider, and blade close contact portions which are in close contact with inner surfaces of the upper blade and the lower blade.

In a state that the slider is held at the sliding limit position on the closing side, a center press contact part in which the right and left insertion leg portions of the stopper member are in press contact with each other and right and left tip end parts of the blade close contact portions are in press contact with each other is formed. Further, the center press contact part is formed (maintained) even in a state that the slider is moved from the sliding limit position on the closing side, and then the guide column of the slider is separated from the insertion base portions of the stopper member, and the blade close contact portions of the stopper member are held at a position of being in close contact with the upper blade and the lower blade of the slider.

Therefore, in addition to a case the slider is held at the sliding limit position on the closing side, even when the slider is moved slightly inward from the sliding limit position on the closing side, and then the guide column of the slider is separated from the insertion base portions of the stopper member and the blade close contact portions of the stopper member are held at the above-described sliding limit vicinity position which are in close contact with the upper blade and the lower blade of the slider, it is possible to stably maintain a state that the stopper member seals the accommodating space portion accommodating the guide column of the slider, and to properly exert watertightness and airtightness. Accordingly, in the present invention, it is possible to improve the reliability of the waterproof function compared to the conventional ones.

In such a waterproof slide fastener of the present invention, a flange portion of the slider includes a straight portion extending linearly along the slider sliding direction from the rear mouth of the slider and a curved portion extending to curve outward from the end part of the straight portion. The right and left flange press contact portions of the stopper member respectively include a press contact curved portion curving corresponding to the curved portion of the flange portion in the slider and a press contact straight portion extending linearly along the slider sliding direction from the rear mouth-side end part of the press contact curved portion toward a rear mouth. Further, in a state that the slider is held at the sliding limit position, right and left outer side press contact parts in which the flange press contact portions of the stopper member are in press contact with the flange portions are formed. Further, the center press contact part and the right and left outer side press contact parts include rear press contact regions extending toward the rear mouth side of the slider from a boundary position between the straight portions and the curved portions of the flange portions in the slider sliding direction.

According to the waterproof slide fastener of the present invention having such a configuration, since the above-described center contact part and the right and left outside contact parts include the rear press contact regions, even when the slider is held at the sliding limit vicinity position slightly inside away from the sliding limit position on the closing side, the center press contact part and the right and left outer side press contact parts are maintained. Accordingly, since the sealed state of the accommodating space portion can be maintained even at the sliding limit vicinity position, it is possible to stably exert favorable watertightness and airtightness of the waterproof slide fastener.

In the waterproof slide fastener of the present invention having the above-described configuration, a length dimension in the slider sliding direction of the rear press contact region in the center press contact part and a length dimension in the slider sliding direction of the rear press contact region in at least one of the right and left outer side press contact parts are set to be smaller than a length dimension in the slider sliding direction of the straight portion in the flange portion. Thereby, in a state that the slider is held at the sliding limit position on the closing side, it is possible to insert and hold not only the stopper member but at least a part of a fastener element disposed adjacently to the stopper member into the element guide path of the slider. As a result, when a lateral pulling force pulling outward in a tape width direction is applied to the waterproof slide fastener in a state that the waterproof slide fastener is completely closed, for example, the fastener element held in the element guide path is in contact with the flange portions of the slider, which makes it possible to maintain the state that the right and left waterproof tapes are in close (press) contact with each other at the end part of the element row. Therefore, watertightness and airtightness of the waterproof slide fastener can be stably exerted properly.

In the present invention, in a state that the slider is held at the sliding limit position on the closing direction side, a movement allowing gap is formed between a peripheral surface of the rear mouth side end part in the guide column of the slider and inner peripheral surfaces of the insertion leg portions disposed behind the rear of the peripheral surface of the rear mouth side end part.

Further, a length dimension in the slider sliding direction of each of the rear press contact regions in the center press contact part and the right and left outer side press contact parts in is set to be larger than a minimum length dimension in the slider sliding direction of the movement allowing gap.

Thereby, even when the slider is moved and separated from the sliding limit position on the closing side, the outer side press contact parts of the stopper member are in press contact with the flange portions of the slider, the right and left insertion leg portions are in press contact with each other, and the right and left tip end parts of the blade close contact portions are in press contact with each other until the peripheral surface of the rear mouth side tip end portion of the guide column in the slider comes in contact with the right and left insertion leg portions. Therefore, watertightness and the airtightness of the waterproof slide fastener can be properly exerted.

Further in the present invention, the length dimension of the rear press contact region in the center press contact part and the length dimension of the rear press contact region in one of the right and left outer side press contact parts are set to be smaller than the length dimension of the rear press contact region in the other of the right and left outer side press contact parts. Particularly, a difference between the length dimension of the rear press contact region in the center press contact part and the length dimension of the straight portion in the flange portion, and a difference between the length dimension of the rear press contact region in one of the right and left outer side press contact parts and the length dimension of the straight portion in the flange portion is set to be larger than ⅓, and preferably larger than ½ of a maximum length dimension of a fastener element of the element row in the slider sliding direction.

Thereby, in a state that the slider is held at the sliding limit position on the closing side, it is possible to insert and hold the fastener element disposed adjacently to the stopper member into the element guide path of the slider in a range larger than ¼, and preferably larger than ⅓ of the maximum length dimension of the fastener element. Therefore, even when a lateral pulling force is applied to the waterproof slide fastener in a closed state, it is possible to stably maintain a state that the right and left waterproof tapes are in close (press) contact with each other.

In the present invention, the blade close contact portions are formed of protruded rib portions protruding continuously on both top and back surfaces of the insertion base portion and right and left insertion leg portions at inner side edge parts. In a state that the right and left outer side press contact parts are in press contact with the flange portions, the protruded rib portions surround the guide column of the slider when viewing a cross section orthogonal to a tape top and back direction and keep an inside region of the protruded rib portions in a sealed state.

Since the blade close contact portions of the present invention are formed of the protruded rib portions, it is possible to obtain an effect of suppressing an increase in the sliding friction of the slider due to close contact of the blade close contact portions. In addition, not only when the slider is held at the sliding limit position, but also when the slider is held at the sliding limit vicinity position, and then the right and left outer side press contact parts are in press contact with the flange portions, the accommodating space portion accommodating the guide column of the slider is sealed by the protruded rib portions. Therefore, watertightness and the airtightness of the waterproof slide fastener can be properly exerted.

MODES FOR CONDUCTING THE INVENTION

Hereinafter, modes for conducting the invention will be described in detail showing embodiments with reference to the drawings. It should be noted that the present invention is not limited to the embodiments explained as below, and various changes can be made as long as having a substantially same structure and similar functional effects to the present invention.

In the following embodiments, for example, a waterproof slide fastener in which a first stopper member and a second stopper member are disposed adjacently to both end parts of the element rows. However, the present invention also includes a waterproof slide fastener in which a separable rear end stop is provided adjacently to the end part on a separating direction side of the element rows instead of the second stopper member. Further, in the present invention, as long as fastener elements are formed by injection molding of synthetic resin, the shape or dimension of the fastener elements can be changed arbitrarily.

Figure 1:
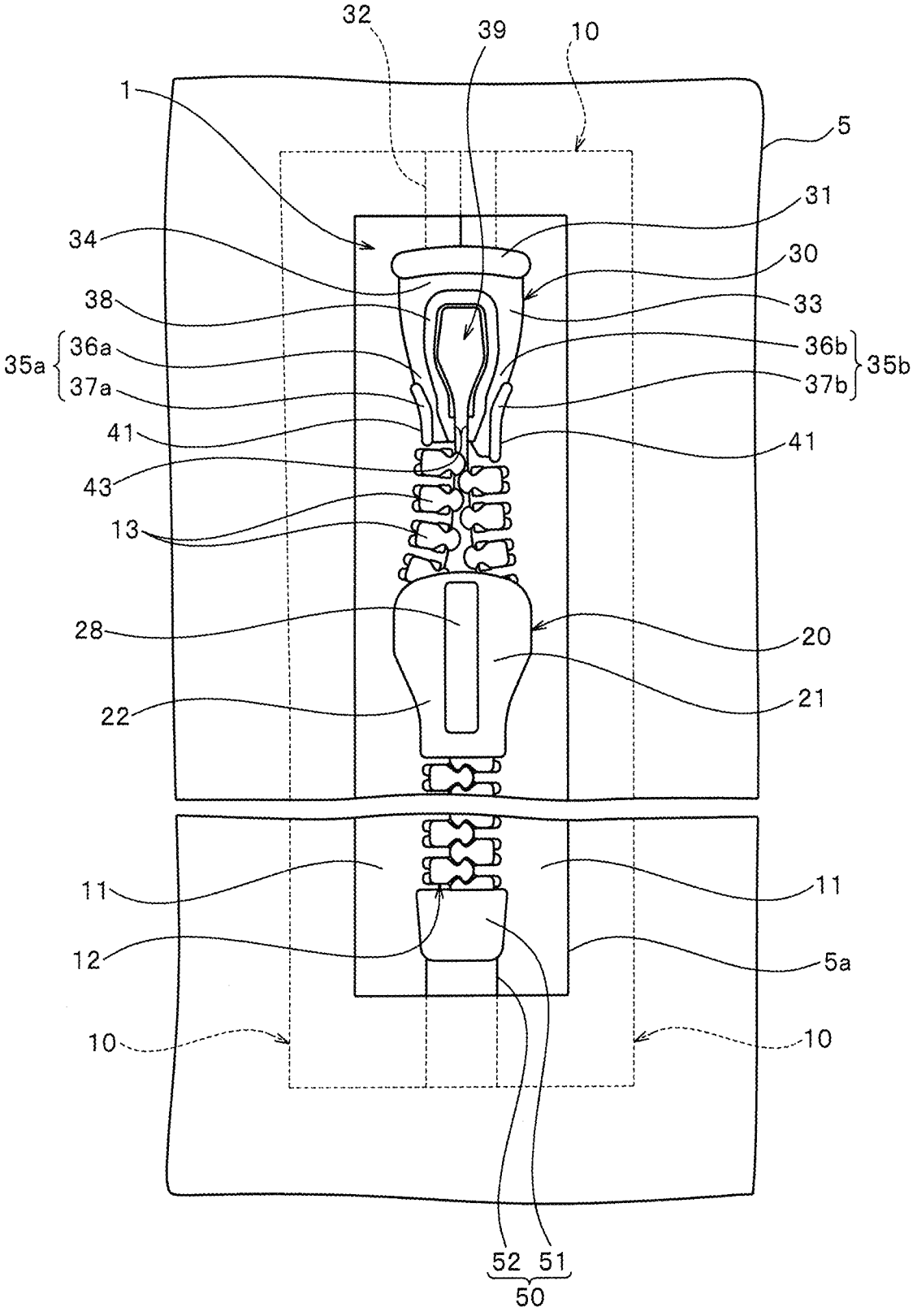
FIG. 1 is a plan view of the waterproof slide fastener according to an embodiment of the present invention.
Figure 2:
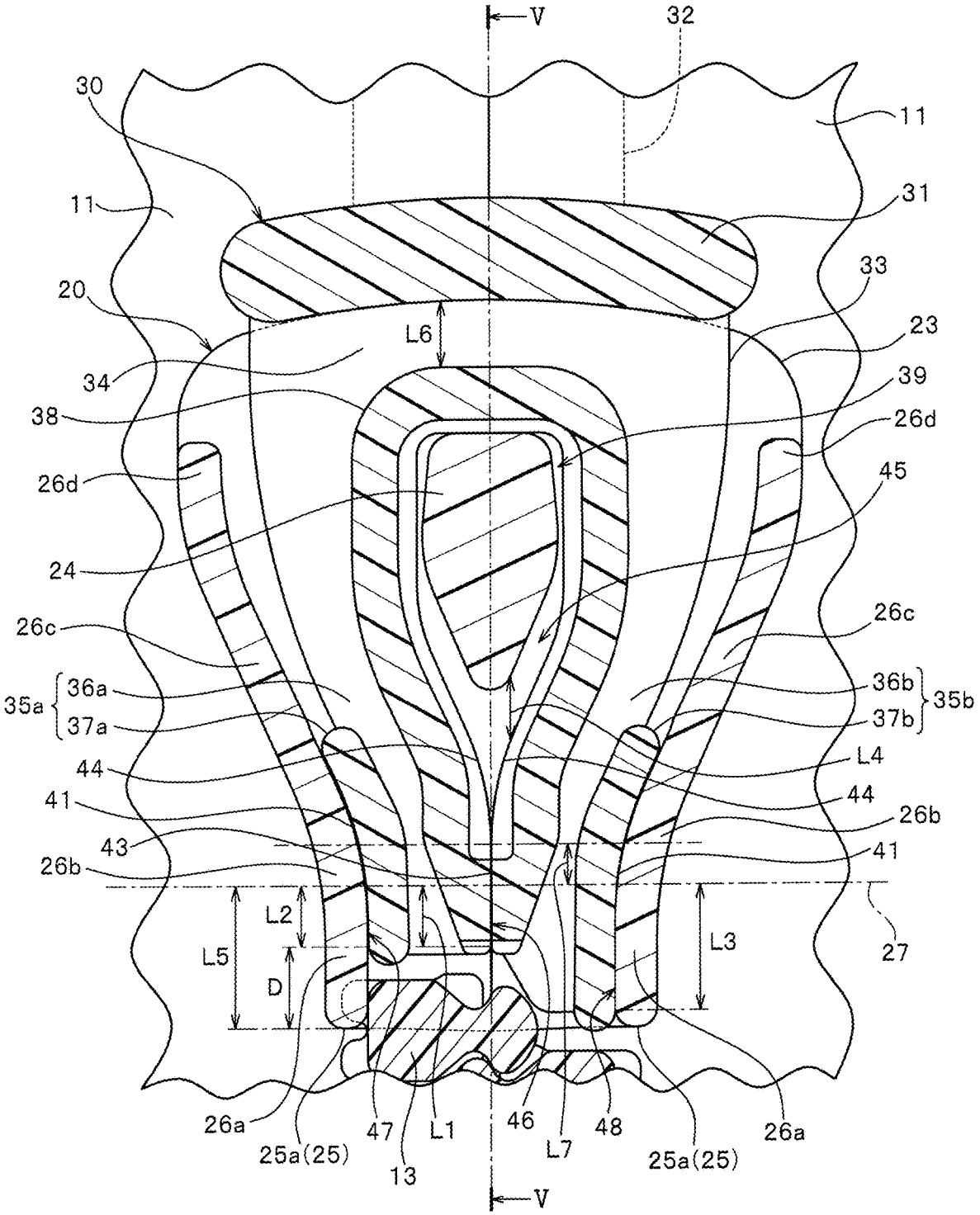
FIG. 2 is a cross-sectional view illustrating a state that the slider is held at a sliding limit position on a closing side on which the slider comes in contact with the first stopper member.
Figure 3:
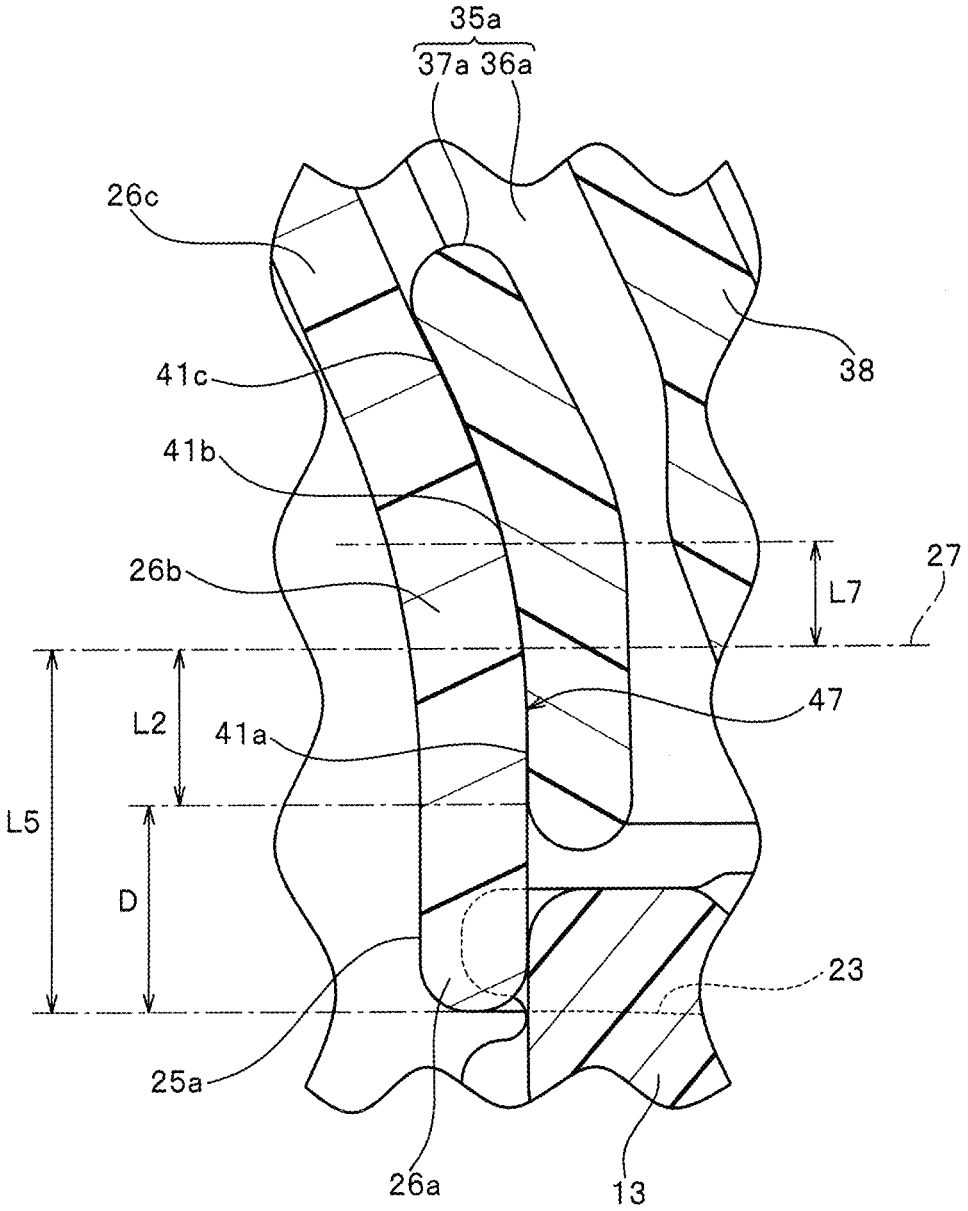
FIG. 3 is a partially enlarged cross-sectional view illustrating a vicinity of left press contact bulged portion in the first stopper member in FIG. 2 enlarged.
Figure 4:
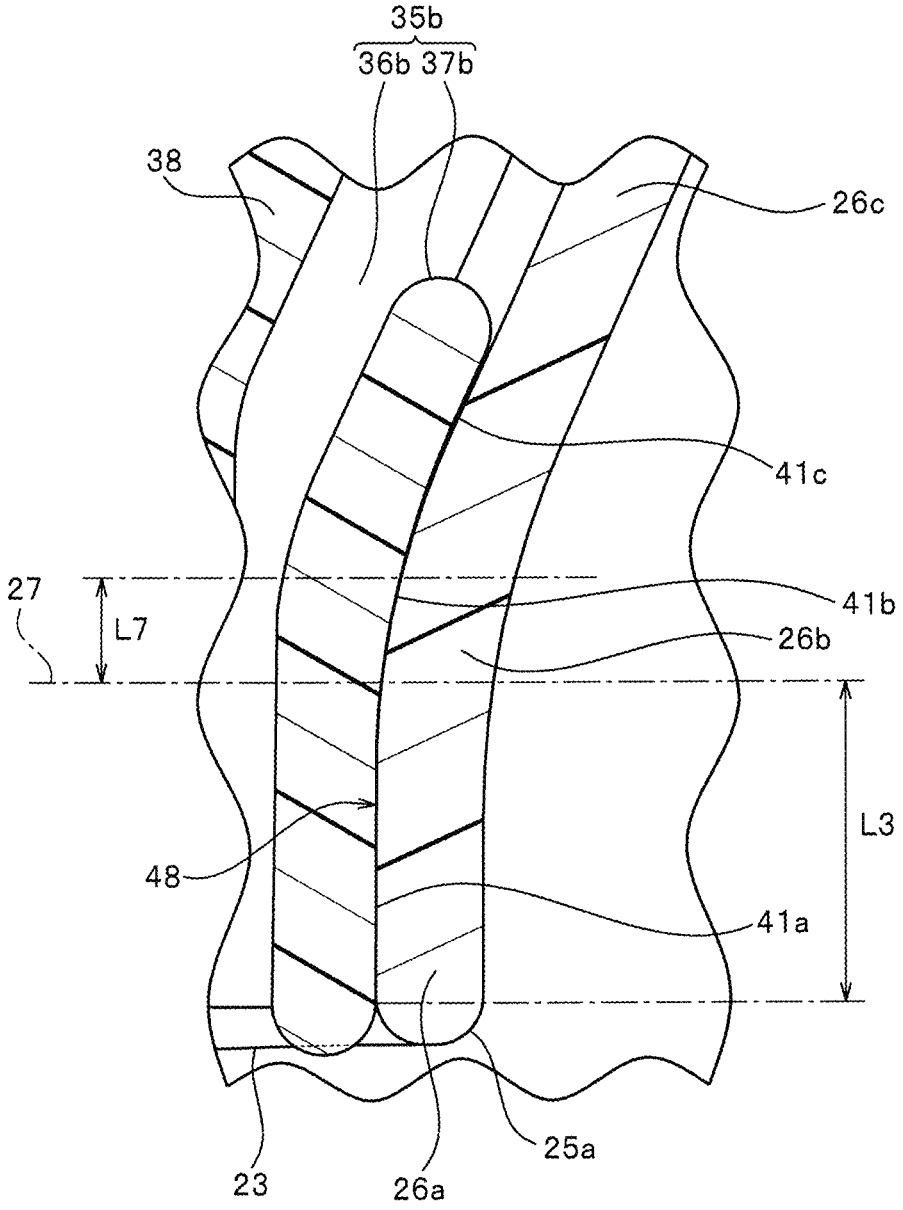
FIG. 4 is a partially enlarged cross-sectional view illustrating a vicinity of the right press contact bulged portion of the first stopper member in FIG. 2 enlarged.
Figure 5:
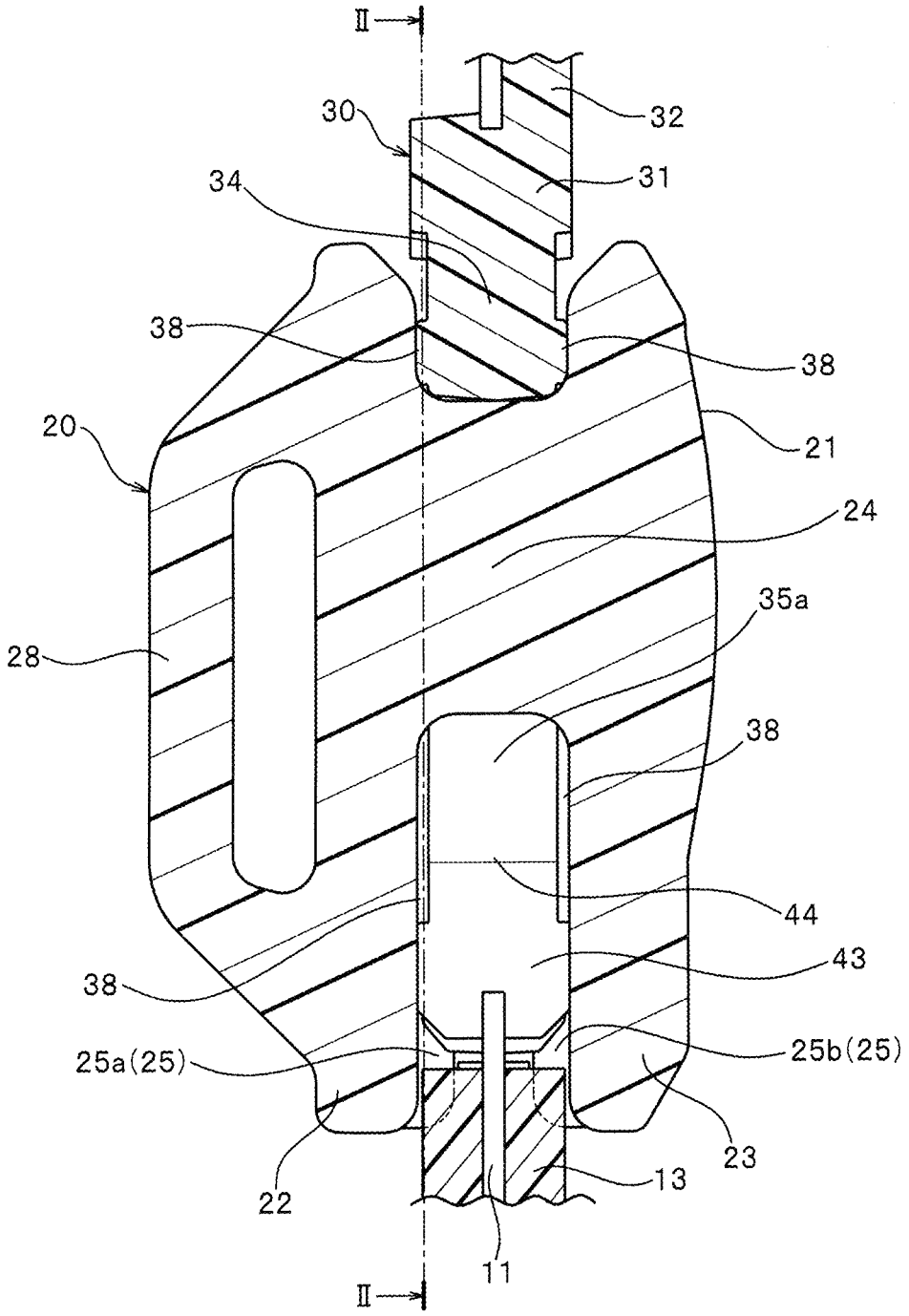
FIG. 5 is a cross-sectional view viewed along line V-V illustrated in FIG. 2.

Here, FIG. 1 is a plan view of a waterproof slide fastener according to the present embodiment. FIG. 2 is a cross-sectional view illustrating a state in which a slider is held at a sliding limit position on a closing side in the waterproof slide fastener of the present embodiment. FIG. 3 and FIG. 4 are partially enlarged cross-sectional views illustrating a part of FIG. 2 enlarged. FIG. 5 is a cross-sectional view viewed along line V-V illustrated in FIG. 2. The cross-sectional view of FIG. 2 illustrates the cross section viewed along line II-II shown in FIG. 5.

In the following description, a front and rear direction means a tape length direction of the waterproof tape, and is referred to as a straight-line direction same as a sliding direction in which the slider slides. Particularly, a closing direction in which the slider slides such that right and left element rows are coupled is referred to as a front, and a separating direction in which the slider slides such that the element rows are disengaged is referred to as a rear.

A right and left direction means a tape width direction of the waterproof tape, and is a direction parallel to a tape surface of the waterproof tape and orthogonal to the tape length direction. Particularly, a right direction and a left direction in a plan view of the waterproof slide fastener as shown in FIG. 1 are respectively referred to as a right and a left. An upper and lower direction means the tape top and back direction orthogonal to a tape top and back surfaces of the waterproof tape. Particularly, the direction which is orthogonal to the front and rear direction and the right and left direction and the direction in which a tab of the slider is disposed with respect to the waterproof tape is referred to as a top, and the opposite direction is referred to as a back.

The waterproof slide fastener 1 according to the present embodiment, as shown in FIG. 1, is used by being attached to an open mouth part 5*a* (or open and close part) of a fastener attached product 5 such as waterproof suits. When the waterproof slide fastener 1 shown in FIG. 1 is closed, waterproof property of the waterproof slide fastener 1 can be exerted, and liquid such as water or air can be prevented from entering inside of the fastener attached product 5 via the waterproof slide fastener 1.

The waterproof slide fastener 1 of the present embodiment includes a right and left pair of fastener stringers 10 in which element rows 12 are formed at facing tape side edge parts of the waterproof tapes 11, a slider 20 capable of sliding along the right and left element rows 12, a first stopper member 30 (also referred to as a first slider stopper member or an upper stopper) disposed adjacently to front end parts which are end parts on a closing direction side in the element rows 12, and a second stopper member 50 (also referred to as a second slider stopper member or a lower stopper) disposed adjacently to rear end parts which are end parts on a separating direction side in the element rows 12.

Each of the fastener stringers 10 of the present embodiment includes the waterproof tape 11 and a plurality of synthetic resin made fastener elements 13 which are injection molded at a tape side edge part of the waterproof tape 11. Each of the right and left element rows 12 is formed of a plurality of fastener elements 13 lined along a tape length direction at the tape side edge part of the waterproof tape 11.

The waterproof tape 11 is formed by providing a waterproof layer made of thermoplastic elastomer on a tape (fastener tape) woven or knitted in a belt shape on both tape top surface (first tape surface) and tape back surface (second tape surface). It should be noted that in the present invention the waterproof tape 11 can be formed by providing a waterproof layer only on one tape surface (tape top surface, for example) of the fastener tape.

The fastener element 13 is formed by injection molding a thermoplastic resin such as polyacetal, polyamide, polypropylene, polybutylene terephthalate, nylon, polycarbonate or the like and by being fixed to a waterproof layer of the waterproof tape 11. The fastener element 13 has a symmetrical shape in the top and back direction (upper and lower direction) with reference to a center position in the tape top and back direction of the waterproof tape 11.

The fastener element 13 includes an oval-shaped coupling head portion, a neck portion formed continuously from the coupling head portion and having a constricted shape, a body portion formed continuously from the neck portion, a thin plate-shaped shoulder portion extending in the upper and lower direction from the neck portion and the body portion, and a front and rear pair of fin portions branching from tape inner side end part of the body portion and extending in the tape width direction.

In this case, the fin portions of the fastener element 13 are formed to have a thickness capable of being inserted between an upper flange portion 25*a* and a lower flange portion 25*b* of the slider 20, described later. At a top end part (tip end part) of the coupling head portion, fitting concaved portions, not shown, for fitting a shoulder portion of the fastener element 13 on a coupling counterpart side and a tape side edge of the waterproof tape 11, are concaved.

The slider 20 of the present embodiment is formed of synthetic resin or metal. Further, the slider 20 of the present embodiment includes a slider body 21 and a tab, not shown, rotatably held by the slider body 21. The slider body 21 includes an upper blade 22 and a lower blade 23 disposed in parallel with each other, a guide column 24 connecting the upper blade 22 and the lower blade 23 at a central part in the width direction, right and left flange portions 25 disposed at right and left side edge parts of the upper blade 22 and the lower blade 23, and a tab attaching portion 28 disposed on an upper surface of the upper blade 22.

In this case, the upper blade 22 and the lower blade 23 are formed so as to bulge further frontward from a position of a front end surface of the guide column 24. Thereby, when sliding the slider 20 to the sliding limit position on the closing side, as described later, it is possible to smoothly insert an insertion base portion 34 of the first stopper member 30, described later, between the upper blade 22 and the lower blade 23 in a front region of the guide column 24 of the slider 20.

The flange portion 25 of the slider body 21 includes right and left upper flange portions 25*a* suspended from right and left side edge parts of the upper blade 22, and right and left lower flange portions 25*b* standing on right and left side edge parts of the lower blade 23. A tape insertion gap to insert the waterproof tape 11 is formed between the upper flange portions 25*a* and the lower flange portions 25*b*.

In the slider body 21, right and left shoulder mouths are provided so as to interpose the guide column 24 between them. Further, a rear mouth is provided at a rear end of the slider body 21. Furthermore, in the slider body 21, a substantially Y-shaped element guide path communicating the right and left shoulder mouths and the rear mouth is formed so as to be surrounded by the upper blade 22, the lower blade 23, and the flange portions 25.

In the slider 20 of the present embodiment, each of the flange portions 25 (that is, the right and left upper flange portions 25*a* and the right and left lower flange portions 25*b*) includes, as shown in FIG. 2, a rear straight portion 26*a* extending linearly from the rear mouth of the slider 20 along the sliding direction of the slider 20, a curved portion 26*b* extending from a front end of the rear straight portion 26*a* so as to curve outward, an intermediate straight portion 26*c* extending linearly from a front end of the curved portion 26*b* in a direction oblique to the sliding direction of the slider 20, and a shoulder mouth-side tip end portion 26*d* extending to curve from a front end of the intermediate straight portion 26*c*.

In this case, the rear straight portion 26*a* of the flange portion 25 may also be called as a parallel portion. A boundary part between the rear straight portion (parallel portion) 26*a* and the curved portion 26*b* of the flange portion 25 is defined as a flange boundary part, and a position of the flange boundary part in the slider sliding direction is illustrated with a chain line as a boundary position 27 in FIG. 2. The boundary position 27 can be reworded as a position in which the curved portion 26*b* (in particular, an inner side surface of the curved portion 26*b*) begins to curve outward with respect to the rear straight portion 26*a*.

The second stopper member 50 of the present embodiment is formed by injection-molding a thermoplastic elastomer so as to bulge on both of the tape top surface and the tape back surface of the waterproof tape 11. The second stopper member 50 is disposed adjacently to rear end parts of the element rows 12 so as to define a sliding limit position (rear end limit position) on the separating direction side of the sliding range of the slider 20.

The second stopper member 50 includes a main body portion 51 for contacting and stopping the slider 20, and an extending portion 52 extending rearward from the main body portion 51. In this case, the main body portion 51 has a trapezoidal shape in a plan view and is formed to have a larger thickness dimension in the tape top and back direction compared to the fastener element 13. The extending portion 52 has a constant width dimension in a tape width direction and is disposed along the tape length direction. Further, the extending portion 52 is formed to have a smaller thickness dimension in the tape top and back direction and a smaller width dimension in the tape width direction compared to the main body portion 51.

The first stopper member 30 having a characteristic form in the waterproof slide fastener 1 of the present embodiment is formed by injection-molding a thermoplastic elastomer so as to bulge on both of the tape top surface and the tape back surface of the waterproof tape 11. The first stopper member 30 is disposed adjacently to the front end parts of the element rows 12 so as to define a limit position (front end limit position) on the closing direction side of the sliding range of the slider 20.

The first stopper member 30 of the present embodiment includes a thick connecting portion 31 disposed across the right and left waterproof tapes 11 and having a larger thickness dimension than an interval between the upper blade 22 and the lower blade 23 of the slider 20, a slider insertion portion 33 extending rearward from the thick connecting portion 31 and being inserted between the upper blade 22 and the lower blade 23 of the slider 20 (into an the element guide path), and a seal portion 32 extending frontward from the thick connecting portion 31 on the tape back surface side of the waterproof tapes 11. Here, the thickness dimension means the dimension of the waterproof tapes 11 in the tape top and back direction.

The thick connecting portion 31 of the first stopper member 30 has a shape curved slightly convexly frontware in a plan view so as to correspond to the shapes of the front end edges of the upper blade 22 and the lower blade 23 of the slider 20. The thick connecting portion 31 is provided so as not to come in contact with the slider 20 even when the slider 20 is held at the sliding limit position on the closing side, as shown in FIG. 5. However, the thick connecting portion 31 of the present invention may be formed as a stopper portion for coming in contact with the upper blade 22 and the lower blade 23 of the slider 20 and stopping the slider 20.

The thick connecting portion 31 of the present embodiment is provided to have a larger thickness dimension compared to the slider insertion portion 33 (in particular, an insertion base portion 34 as described later). A level difference on the surface is formed between the thick connecting portion 31 and the slider insertion portion 33 both on the tape top surface side and the tape back surface side. The seal portion 32 of the present embodiment is disposed across the right and left waterproof tapes 11 on the tape back surface side of the waterproof tapes 11, and prevents leakage of liquid from between the right and left waterproof tapes 11 in a region in front of the thick connecting portion 31.

The slider insertion portion 33 of the first stopper member 30 has an inverted U-shape in a plan view, and has elasticity capable of opening or closing the rear end parts of the right and left insertion leg portions 35*a*, 35*b*, described later. The thickness dimension of the slider insertion portion 33 in the tape top front and back direction is set to a size capable of being inserted between the upper blade 22 and the lower blade 23 of the slider 20.

The slider insertion portion 33 of the present embodiment includes an insertion base portion 34 disposed to be connected to the thick connecting portion 31 and to be extended in the tape width direction across the right and left waterproof tapes 11, a left insertion leg portion 35*a* and a right insertion leg portion 35*b* branching from the insertion base portion 34 and respectively extending toward the right and left element rows 12, and close contact protruded rib portions 38 protruded at inner side edge parts of the insertion base portion 34 and the right and left insertion leg portions 35*a*, 35*b* on the both top and back surfaces. Further, in the slider insertion portion 33, an accommodating space portion 39 surrounded by the insertion base portion 34 and the right and left insertion leg portions 35*a*, 35*b* in a state that the slider 20 is held at the sliding limit position on the closing side is formed. The guide column 24 of the slider 20 is accommodated in the accommodating space portion 39.

The right and left insertion leg portions 35*a*, 35*b* of the slider insertion portion 33 are formed with mutually different lengths from the insertion base portion 34. In a case of the present embodiment, for example, since the fastener element 13 disposed at the frontmost end of the right and left element rows 12 is provided on the left waterproof tape 11, the left insertion leg portion 35*a* is formed to be shorter than the right insertion leg portion 35*b*. In the present invention, the left insertion leg portion 35*a* may be formed longer than the right insertion leg portion 35*b*, or the right and left insertion leg portions 35*a*, 35*b* may be formed to have the same length.

Each of the right and left insertion leg portions 35*a*, 35*b* respectively includes leg piece main body portions 36*a*, 36*b* having a constant thickness and press contact bulged portions 37*a*, 37*b* disposed at outer side edge parts of the tip end parts (rear end parts) of the insertion leg portions 35*a*, 35*b* and in press contact with the upper flange portion 25*a* and the lower flange portion 25*b* of the slider 20. Here, the tip end parts of the insertion leg portions 35*a*, 35*b* are end parts (rear end parts) on the element row 12 side.

The press contact bulged portions 37*a*, 37*b* are disposed to bulge to an outside of the leg piece main body portions 36*a*, 36*b*, and has a larger thickness dimension than those of the leg piece main body portions 36*a*, 36*b*. The outer side surfaces of the press contact bulged portions 37*a* and 37*b* are flange press contact surfaces (flange press contact portions) 41 with which the slider 20 comes in press contact when being held at the sliding limit position on the closing side. In this case, a position that the upper flange portion 25*a* and the lower flange portion 25*b* of the slider 20 come in contact with the press contact bulged portions 37*a*, 37*b* of the first stopper member 30 so as not to be able to move further frontward is the sliding limit position of the slider 20 on the closing side.

In this case, the press contact bulged portions 37*a*, 37*b* have shapes corresponding to the shapes of the subject parts with which the upper flange portion 25*a* and the lower flange portion 25*b* of the slider 20 come in contact (that is, the rear straight portions 26*a*, the curved portions 26*b*, and the intermediate straight portions 26*c* of the upper flange portion 25*a* and the lower flange portion 25*b*), as shown in FIG. 2 to FIG. 4. Therefore, the flange press contact portions 41 formed of the outer side surfaces of the right and left press contact bulged portions 37*a*, 37*b* include first press contact straight portions 41*a* in press contact with the rear straight portions 26*a* of the flange portion 25, press curved portions 41*b* in press contact with the curved portions 26*b* of the flange portion 25, and second press contact straight portions 41*c* in press contact with the intermediate straight portions 26*c* of the flange portion 25.

The first press contact straight portions 41*a* of the right and left flange press contact portions 41 linearly extend rearward along the sliding direction (tape length direction) of the slider 20 from rear ends of the press contact curved portions 41*b*. The press contact curved portions 41*b* are formed to be curved such that an interval between the right and left flange press contact portions 41 gradually decreases rearward. The second press contact straight portions 41*c* linearly extend from front ends of the press contact curved portions 41*b* along an oblique direction with respect to the sliding direction (tape length direction) of the slider 20.

Further, in the insertion leg portions 35*a*, 35*b* of the present embodiment, when the slider 20 is held at the sliding limit position on the closing side, only the press contact bulged portions 37*a*, 37*b* of the insertion leg portions 35*a*, 35*b* are in contact with the upper flange portions 25*a* and the lower flange portions 25*b* of the slider 20, and parts of the insertion leg portions 35*a*, 35*b* other than the press contact bulged portions 37*a*, 37*b* are formed to be non-contact parts which are not in contact with the upper flange portions 25*a* and the lower flange portions 25*b*.

The tip end parts (rear end parts) of the right and left insertion leg portions 35*a*, 35*b* include inner side press contact surfaces (inner side press contact portions) 43 in which the right and left press contact bulged portions 37*a*, 37*b* are in press contact with the upper flange portions 25*a* and the lower flange portions 25*b* of the slider 20 and each of the insertion leg portions 35*a*, 35*b* are pressed toward an inside, thereby, the right and left insertion leg portions 35*a*, 35*b* are in press contact with each other. In this case, the inner side press contact surfaces 43 disposed on the right and left insertion leg portions 35*a*, 35*b* form to be substantially the same surface as the facing tape side surfaces of the right and left waterproof tapes 11.

Furthermore, the right and left insertion leg portions 35*a*, 35*b* respectively include an inner side curved surface 44 curving convexly toward an inside in a plan view. The inner side curved surface 44 is disposed continuously toward the insertion base portion 34 side from the above-described inner side press contact surface 43. Since the inner side curved surface 44 is provided, it is expected that a sliding friction of the slider 20 when sliding the slider 20 from the sliding limit position on the closing side toward the separating direction of the element rows 12 is reduced, as described later.

In the present embodiment, the sum of a width dimension in the tape width direction from an outer side surface of the first press contact straight portion 41*a* to the inner side press contact surface 43 in the left insertion leg portion 35*a* and a width dimension in the tape width direction from an outer side surface of the first press contact straight portion 41*a* to the inner side press contact surface 43 in the right insertion leg portion 35*b* (that is, the sum of the width dimension of the part on which the first press contact straight portions 41*a* of the right and left insertion leg portions 35*a*, 35*b* are disposed) is set to be slightly larger than an interval between the rear straight portions 26*a* of the right and left flange portions 25 at the rear mouth side end parts in the slider 20. Thereby, when the slider 20 is moved to the sliding limit position on the closing side, the right and left flange portions 25 of the slider 20 and the right and left press contact bulged portions 37*a*, 37*b* of the first stopper member 30 can be stably in press contact with each other. Also the right and left insertion leg portions 35*a*, 35*b* can be stably pressed toward an inside.

Further, in this case, the above-described rear straight portion 26*a* of the flange portion 25 in the slider 20 means a part of the region in which in the flange portion 25, an interval between the right and left flange portions 25 (that is, a dimension in the tape width direction from an inner side surface of the left flange portion 25 to an inner side surface of the right flange portion 25) is equal to or smaller than the size of the above-described "the sum of the width dimension of the part on which the first press contact straight portions 41*a* of the right and left insertion leg portions 35*a*, 35*b* are disposed". Therefore, the front end part of the rear straight portion 26*a* of the flange portion 25 may include a part curving outward.

Further, in the present invention, as long as the right and left insertion leg portions 35*a*, 35*b* are respectively provided with the flange press contact surfaces (flange press contact portions) 41 to be in press contact with the upper flange portion 25*a* and the lower flange portion 25*b* of the slider 20 as described above, each of the insertion leg portions may be formed to have a constant thickness as a whole without having the above-described press contact bulged portions 37*a*, 37*b*. In a case when the insertion leg portion is formed to have a constant thickness as a whole, the outer side surfaces of the tip end parts of the insertion leg portions become flange press contact surfaces (flange press contact portions) 41 in press contact with the upper flange portions 25*a* and the lower flange portions 25*b* of the slider 20.

The close contact protruded rib portions 38 of the slider insertion portion 33 in the present embodiment are continuously provided peripherally at the inner side edge parts of the insertion base portion 34 and the right and left insertion leg portions 35*a*, 35*b*. The close contact protruded rib portions 38 are provided in a protruding manner to have a predetermined height dimension capable of being in press contact with the upper blade 22 and the lower blade 23 of the slider 20 on the top surface and the back surface of the insertion base portion 34 and the right and left insertion leg portions 35*a*, 35*b*. In this case, the close contact protruded rib portion 38, except for a tip end part (rear end part) of the close contact protruded rib portion 38, is disposed along the inner side edges of the insertion base portion 34 and the right and left insertion leg portions 35*a*, 35*b* at a position away from the inner side edges.

It should be noted that in the present embodiment the size (width) of the close contact protruded rib portion 38 can be arbitrarily changed. Further, in the present embodiment, one continuous close contact protruded rib portion 38 is provided in a protruding manner respectively on the top surface and the back surface of the slider insertion portion 33. In the present invention, however, a plurality of continuous close contact protruded rib portions 38 may be provided in a protruding manner respectively so as to line on the top surface and the back surface of the slider insertion portion 33. Furthermore, in the present invention, the insertion base portion 34 and the right and left insertion leg portions 35*a*, 35*b* may be formed to have a constant height dimension (thickness dimension) such that the top surface and the back surfaces of the insertion base portion 34 and the right and left insertion leg portions 35*a*, 35*b* come in close contact with the upper blade 22 and the lower blade 23 of the slider 20 entirely without providing the close contact protruded rib portion on the slider insertion portion 33. In this case, the insertion base portion 34 and the right and left insertion leg portions 35*a*, 35*b* as a whole form the blade close contact portion in close contact with the upper blade 22 and the lower blade 23.

Furthermore, the right and left tip end parts of the close contact protruded rib portion 38 have sloped surfaces which slope downward so as to gradually decrease a height dimension of the close contact protruded rib portion 38 rearward. Thereby, when the close contact protruded rib portion 38 is inserted into the element guide path of the slider 20, it is possible to prevent the tip end parts of the close contact protruded rib portion 38 from being caught by the upper blade 22 or the lower blade 23 of the slider 20, and to improve the operability of the slider 20.

Further, at the right and left tip end parts (rear end parts) of the close contact protruded rib portion 38 of the present embodiment, the inner side press contact surfaces (inner side press contact parts) 43 forming the same plane as the inner side press contact surfaces 43 of the right and left insertion leg portions 35*a*, 35*b* and being in press contact with each other by the right and left press contact bulged portions 37*a*, 37*b* in press contact with the upper flange portions 25*a* and the lower flange portions 25*b* of the slider 20.

Thereby, when the slider 20 is moved to the sliding limit position on the closing side, and then the right and left press contact bulged portions 37*a*, 37*b* of the first stopper member 30 come in press contact with the upper flange portion 25*a* and the lower flange portion 25*b* of the slider 20, the right and left tip end parts of the close contact protruded rib portion 38 come in press contact with each other along with the tip end parts of the right and left insertion leg portions 35*a*, 35*b*, which makes it possible to surround the accommodating space portion 39 accommodating the guide column 24 of the slider 20 so as not to make a gap. As a result, it is possible to make the accommodating space portion 39 in a sealed state in which neither liquid such as water nor air enters.

In such a waterproof slide fastener 1 of the present embodiment, the slider 20 is slid in the closing direction and stopped at the sliding limit position on the closing side in which the upper flange portion 25*a* and the lower flange portion 25*b* of the slider 20 are in press contact with the right and left press contact bulged portions 37*a*, 37*b* of the first stopper member 30, as shown in FIG. 2.

In this case, the slider insertion portion 33 of the first stopper member 30 is inserted into the element guide path of the slider 20, and top end surfaces (upper end surface and lower end surface) of the close contact protruded rib portion 38 of the slider insertion portion 33 are in close contact with the inner surface of the upper blade 22 and the inner surface of the lower blade 23 of the slider 20. Along with that, the front end surface of the guide column 24 of the slider 20 comes in contact with the inner side edge (inner side edge surface) of the insertion base portion 34 in the first stopper member 30. At the same time, a peripheral surface of the rear end part of the guide column 24 in the slider 20 facing the rear mouth side is separated from the rear end parts of the insertion leg portions 35*a*, 35*b* disposed behind (in particular, the above-described inner side curved surface 44 of the rear end part) to form a movement allowing gap 45 in which the guide column 24 of the slider 20 is able to move is formed between them.

In addition, in a case when the slider 20 is held at the above-described sliding limit position, the right and left outer side press contact parts 47, 48, which are to be the parts in which the right and left press contact bulged portions 37*a*, 37*b* of the first stopper member 30 are in press contact with the upper flange portions 25*a* and the lower flange portions 25*b* of the slider 20, are formed, as shown in FIG. 2 to FIG. 4. Along with that, a center press contact part 46, which is to be the part in which the inner side press contact surfaces 43 of the right and left insertion leg portions 35*a*, 35*b* are in press contact with each other and the right and left tip end parts of the close contact protruded rib portions 38 are in press contact with each other, is formed between the right and left outer side press contact parts 47, 48.

At this time, the above-mentioned center press contact part 46 and the right and left outer side press contact parts 47, 48 have rear press contact regions extending linearly on the rear mouth side of the slider 20 from the above-mentioned boundary position 27 as shown in FIG. 2. Particularly in this case, a length dimension L1 in the slider sliding direction of the rear press contact region in the center press contact part 46 and a length dimension L2, L3 in the slider sliding direction of the rear press contact region in the right and left outer side press contact parts 47, 48 are set to be larger than a minimum length dimension L4 of the movement allowing gap 45 in the slider sliding direction formed between the guide column 24 of the slider 20 and the rear end parts of the insertion leg portions 35*a*, 35*b*.

Therefore, as will be described later with reference to FIG. 6, for example, even when the slider 20 is slid from the sliding limit position on the closing side toward the separating direction of the element rows 12, the right and left press contact bulged portions 37*a*, 37*b* are in press contact with the upper flange portions 25*a* and the lower flange portions 25*b* of the slider 20, thereby, the state that the right and left outer side press contact parts 47, 48 are formed is maintained until the guide column 24 of the slider 20 is in contact with the right and left insertion leg portions 35*a*, 35*b*. At the same time, the tip end parts of the right and left insertion leg portions 35*a*, 35*b* are in press contact with each other and the right and left tip end parts of the close contact protruded rib portions 38 are in press contact with each other, thereby the state that the center press contact part 46 is formed is maintained. Therefore, it is possible to stably keep the sealed state of the accommodating space portion 39. In this state, the size of the gap in the slider sliding direction formed between the front end surface of the guide column 24 in the slider 20 and the insertion base portion 34 is from 1.0 mm to 2.0 mm. In this case, the size of the gap between the guide column 24 and the insertion base portion 34 may be replaced by a distance in which the slider 20 is moved from the above-mentioned sliding limit position rearward (separating direction of the element rows 12) instead of actually measuring.

Further, the right and left outer side press contact portions 47, 48 have front press contact regions extending toward the shoulder mouth side of the slider 20 from the above-described boundary position 27 in the upper flange portions 25*a* and the lower flange portions 25*b* as shown in FIG. 2. The front press contact region is a part in which, in a state that the inner side surfaces of the right and left insertion leg portions 35*a*, 35*b* come in contact with each other, a dimension in the tape width direction from a point coming in contact with the left flange portion 25 in the outer side surface of the left insertion leg portion 35*a* to a point coming in contact with the right flange portion 25 in the outer side surface of the right insertion leg portion 35*b* is equal to or larger than a dimension in the tape width direction between corresponding parts in the curved portions 26*b* of the right and left flange portions 25.

In this case, a total dimension obtained by adding the length dimension L2 in the slider sliding direction of the rear press contact region in the left outer side press contact part 47 to the length dimension L7 of the above-described front press contact region in the slider sliding direction is larger than the minimum length dimension L4 of the movement allowing gap 45 in the slider sliding direction. Therefore, even when the slider 20 is moved within a predetermined range toward the separating direction of the element rows 12, it is possible to keep the sealed state of the accommodating space portion 39 and to maintain watertightness. Particularly in this case, it is more preferable that the length dimension L2 itself of the rear press contact region in the left outer side press contact portion 47 is larger than the minimum length dimension L4 of the movement allowing gap 45. In the present embodiment, the length dimension L7 of the front press contact region is set to be 2.5 mm or more and 5.0 mm or less.

Further in the present embodiment, the center press contact part 46 in which the right and left insertion leg portions 35*a*, 35*b* are in press contact with each other and the right and left tip end parts of the close contact protruded rib portion 38 are in press contact with each other also has a front press contact region extending toward the shoulder mouth side of the slider 20 from the boundary position 27. In this case, a length dimension in the slider sliding direction of the front press contact region in the center press contact part 46 is equal to or less than the length dimension L7 of the front press contact region in the right and left outer side press contact parts 47, 48.

In the first stopper member 30 of the present embodiment, as shown in FIG. 2, when the slider 20 is held at the sliding limit position on the closing side, the length dimension L1 of the rear press contact region in the center press contact part 46 and the length dimension L2 of the rear press contact region in the left outer side press contact part 47 are set to be smaller than the length dimension L3 of the rear press contact region in the right outer side press contact part 48, and is set to be smaller than the length dimension L5 in the slider sliding direction of the rear straight portion 26*a* in the flange portion 25.

Particularly in this case, a difference D between the length dimension L1, L2 of the rear press contact region in the center press contact part 46 and the left outer side press contact part 47 and the length dimension L5 of the rear straight portion 26*a* in the flange portion 25 is set to be larger than ⅓, and preferably larger than ½ of a maximum length dimension of the fastener element 13 in the slider sliding direction.

In the waterproof slide fastener 1 of the present embodiment as described above, the slider 20 is slid toward the first stopper member 30, thereby the right and left element rows 12 are coupled. As a result, the right and left waterproof tapes 11 are in close contact with each other.

Further, the slider 20 is slid and held at the sliding limit position on the closing side, thereby, as shown in FIG. 2, the slider insertion portion 33 of the first stopper member 30 are inserted into the element guide path of the slider 20, and the guide column 24 of the slider 20 passes through between the rear end parts of the right and left insertion leg portions 35*a*, 35*b* in the first stopper member 30 and is accommodated into the accommodating space portion 39. At this time, the close contact protruded rib portions 38 are in close contact with the inner surface of the upper blade 22 and the inner surface of the lower blade 23 in the slider 20.

In addition, when the slider 20 is slid to the sliding limit position on the closing side, the flange portions 25 (that is, the upper flange portion 25*a* and the lower flange portion 25*b*) of the slider 20 come in press contact with outer side surfaces (flange press contact surfaces 41) of the press contact bulged portions 37*a*, 37*b* in the first stopper member 30 to form the right and left outer side press contact parts 47, 48, and the front end surface of the guide column 24 in the slider 20 comes in contact with the inner side edge of the insertion base portion 34 in the first stopper member 30.

At the same time, the flange portions 25 of the slider 20 and the right and left press contact bulged portions 37*a*, 37*b* of the first stopper member 30 come in press contact with each other, thereby, the right and left insertion leg portions 35*a*, 35*b* are pressed toward an inside. Therefore, the center press contact parts 46 in which the rear end parts of the insertion leg portions 35*a*, 35*b* are in press contact with each other, and the right and left rear end parts of the close contact protruded rib portion 38 are in press contact with each other is formed.

As a result, the accommodating space portion 39 accommodating the guide column 24 of the slider 20 and the outside region of the close contact protruded rib portions 38 are blocked by the close contact protruded rib portions 38 in close contact with the upper blade 22 and the lower blade 23 of the slider 20. Therefore, the accommodating space portion 39 becomes a sealed state in which neither liquid such as water nor air enters. As a result, the waterproof slide fastener 1 of the present embodiment, which is attached to the open mouth part 5*a* of the fastener attached product 5, is able to properly exert watertightness and airtightness to prevent liquid such as water or the like and air from entering into the fastener attached product 5.

At this time, in the first stopper member 30 of the present embodiment, the above-described center press contact part 46 and the right and left outer side press contact parts 47, 48 respectively have the rear press contact regions extending rearward from the flange boundary position 27. The length dimensions L1, L2, and L3 in each of the rear press contact regions are set to be larger than the minimum length dimension L4 in the above-mentioned movement allowing gap 45.

As an example of the present embodiment, when specific dimensions of the above-mentioned length dimensions L1 to L4 are shown, the length dimension L1 of the rear press contact region in the center press contact part 46 and the length dimension L2 of the rear press contact region in the left outer side press contact part 47 are set at the same size, namely 2.3 mm. The length dimension L3 of the rear press contact region in the right outer side press contact part 48 is set to be 3.7 mm. The minimum length dimension L4 in the movement allowing gap 45 between the guide column 24 and the rear end parts of the right and left insertion leg portions 35*a*, 35*b* are set to be 2.0 mm. It should be noted that in the present invention, the specific size of the length dimensions L1 to L4 is not limited, and can be arbitrarily changed. For example, the above-mentioned length dimensions L1 and the length dimension L2 may be set to different sizes as long as they are larger than the above-mentioned length dimension L4.

Figure 6:
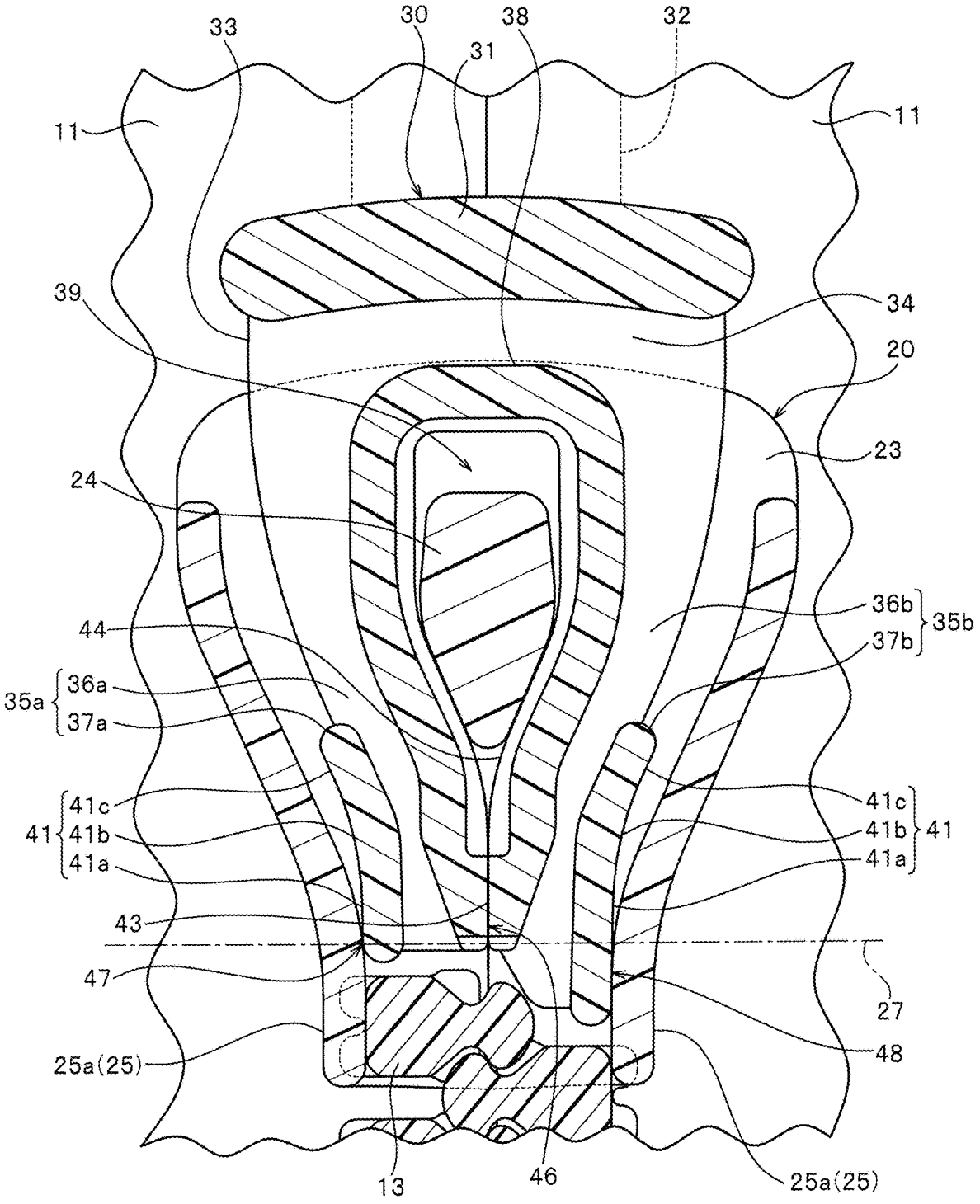
FIG. 6 is a cross-sectional view illustrating a state that the slider is slightly moved from the sliding limit position on the closing side.

Since the length dimensions L1 to L4 are set as above, even when the slider 20 held at the sliding limit position on the closing side is slid unexpectedly by some momentum, and the guide column 24 of the slider 20 is separated slightly from the inner side edge of the insertion base portion 34 in the first stopper member 30, or even when the slider 20 is stopped in the intermediate position of the first stopper member 30 unintentionally without being slid sufficiently to the sliding limit position when the slider 20 is slid toward the first stopper member 30, for example, the press contact state of the center press contact part 46 and the press contact state of the right and left outer side press contact parts 47, 48 are maintained, as shown in FIG. 6, as long as the slider 20 is held at the sliding limit vicinity position within a predetermined range (2 mm in the present embodiment) from the sliding limit position on the closing side.

In other words, as long as the slider 20 is held at a position at which a separation distance in which the front end surface of the guide column 24 in the slider 20 is separated from the inner side edge of the insertion base portion 34 in the first stopper member 30 is equal to or smaller than the above-described minimum length dimension L4 of the movement allowing gap 45 when the slider 20 is at the sliding limit position, the upper flange portion 25*a* and the lower flange portion 25*b* of the slider 20 and right and left press contact bulged portions 37*a*, 37*b* of the first stopper member 30 are in press contact with each other, thereby the state in which the right and left outer side press contact parts 47, 48 are formed is maintained. At the same time, the rear end parts of the insertion leg portions 35*a*, 35*b* are in press contact with each other and the right and left rear end parts of the close contact protruded rib portion 38 are in press contact with each other, thereby, the state in which the center press contact part 46 are formed is maintained.

As a result, it is possible to keep exerting watertightness and airtightness of the waterproof slide fastener 1 stably. Therefore, in a case of the present embodiment, even when the slider 20 is slid within a distance of 2 mm from the sliding limit position on the closing side toward the separating direction of the element rows 12, watertightness and airtightness can be stably ensured.

In a case when the waterproof slide fastener 1 of the present embodiment as above is attached to an open mouth part 5*a* (or open and close part) of the fastener attached product 5, watertightness and airtightness can be exerted by holding the slider 20 at the sliding limit position on the closing side or at the sliding limit vicinity position which is within 2 mm from the sliding limit position. Therefore, the waterproof function of the waterproof slide fastener 1 is highly reliable, and it is possible to prevent the entry of liquid such as water or air into the inside of the fastener attached product 5 via the waterproof slide fastener 1 more effectively than before. The waterproof slide fastener 1 of the present embodiment as described above is more favorably used for dry suits not allowing water to enter inside the suits.

Further, in the waterproof slide fastener 1 of the present embodiment, in a state that the slider 20 is held at the sliding limit position on the closing side as shown in FIG. 2, the length dimensions L1, L2, and L3 of each of the rear press contact regions in the center press contact part 46 and the right and left outer side press contact parts 47, 48 are set to be the size equal to or smaller than the minimum length dimension L6 in the slider sliding direction between the front end edges of the upper blade 22 and the lower blade 23 of the slider 20 and the inner wall surface of the close contact protruded rib portion 38 in the first stopper member 30.

In a case when the slider 20 held at the sliding limit position of the closing side is slid beyond a distance corresponding to the above-described minimum length dimension L6, for example, a part of the close contact protruded rib portions 38 is not in close contact with the inner surface of the upper blade 22 and the inner surface of the lower blade 23, thereby the sealed state of the accommodating space portion 39 is released. In the first stopper member 30 of the present embodiment, until when the part of the close contact protruded rib portions 38 is not in close contact with the inner surface of the upper blade 22 and the inner surface of the lower blade 23, and the sealed state is released, it is not necessary to maintain a press contact state of the center press contact part 46 and a press contact state of the right and left outer side press contact parts 47, 48.

Accordingly, in a state that the slider 20 is held at the sliding limit position on the closing side, the length dimensions L1, L2, and L3 of each of the rear press contact regions in the center press contact part 46 and the right and left outer side press contact parts 47, 48 are set to be the size equal to or smaller than the minimum length dimension L6 in the slider sliding direction between the front end edges of the upper blade 22 and the lower blade 23 and the inner wall surfaces of the close contact protruded rib portions 38, as described above.

Further, in the present embodiment, in a state that the slider 20 is held at the sliding limit position on the closing side, the difference D between the length dimensions L1, L2 of the rear press contact regions in the center press contact part 46 and the left outer side press contact part 47 and the length dimension L5 of the rear straight portion 26*a* in the flange portion 25 is larger than ⅓, and preferably larger than ½ of the maximum length dimension of the fastener element 13 in the slider sliding direction as mentioned above.

Accordingly, as shown in FIG. 2, it is possible to insert and hold a larger part than ¼ of the fastener element 13 in the slider sliding direction disposed at a frontmost end of the element row 12, and preferably a part ⅓ or larger of the fastener element 13 in the slider sliding direction into the element guide path of the slider 20 held at the sliding limit position on the closing side.

Since the part of the fastener element 13 disposed at the frontmost end is held within the element guide path of the slider 20 as above, even when a lateral pulling force is applied to the waterproof slide fastener 1 in a state completely closed by holding the slider 20 at the sliding limit position on the closing side, for example, it is possible to properly prevent formation of a gap between the right and left waterproof tapes 11 in a part between the right and left element rows 12 and the first stopper member 30, and to stably maintain watertightness and airtightness of the waterproof slide fastener 1.

Figure 7:
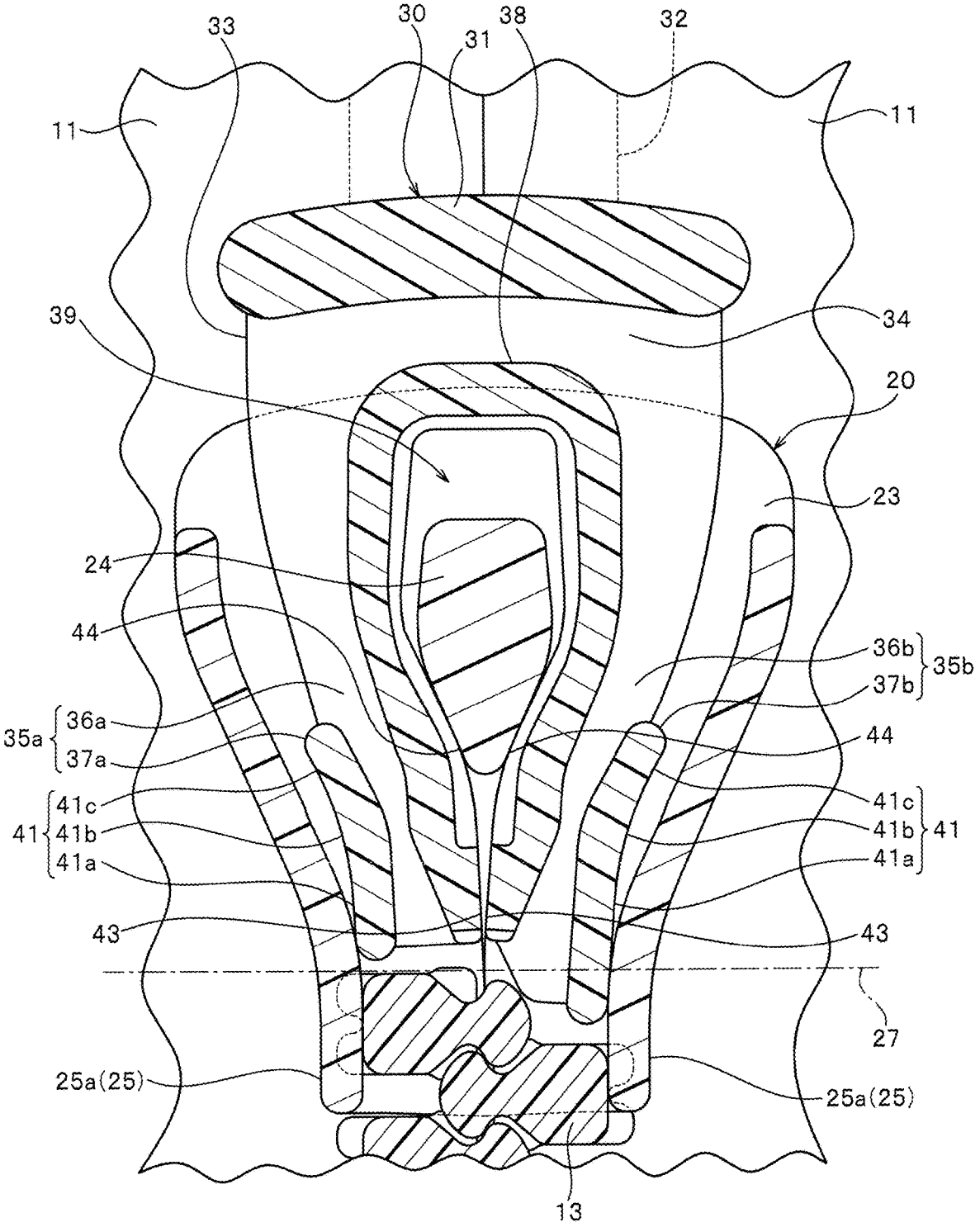
FIG. 7 is a cross-sectional view illustrating a state that the slider is further moved, and then right and left insertion leg portions are separated.
Figure 8:
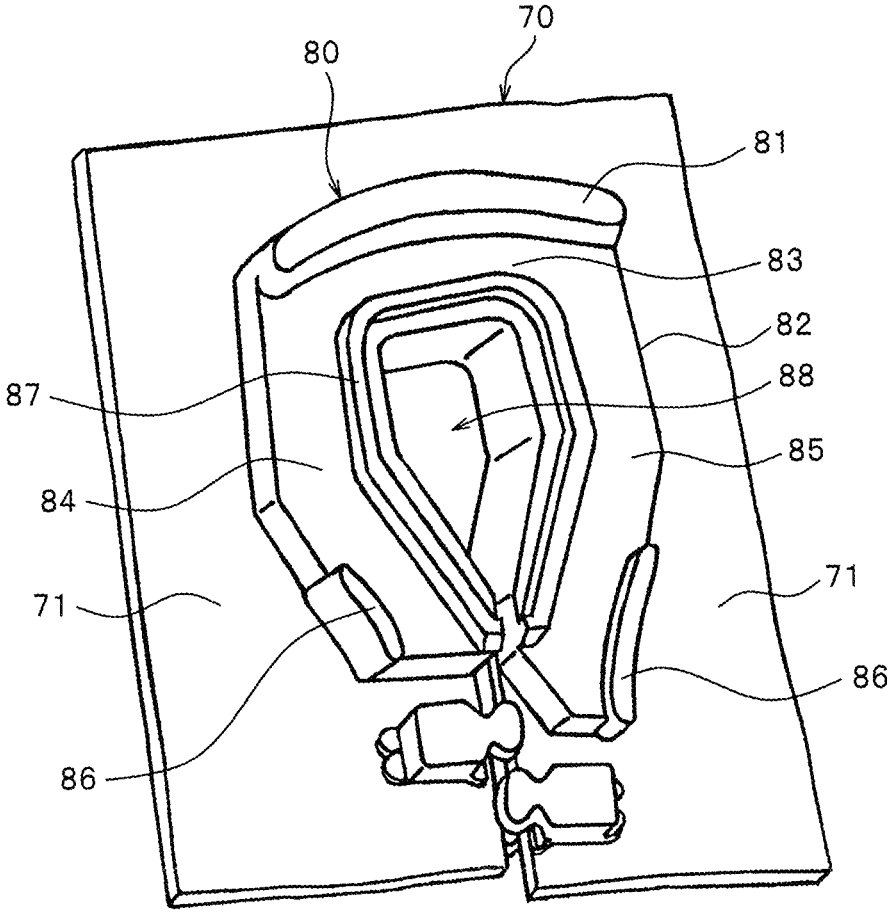
FIG. 8 is a perspective view illustrating a first stopper member disposed on a conventional waterproof slide fastener.
Figure 9:
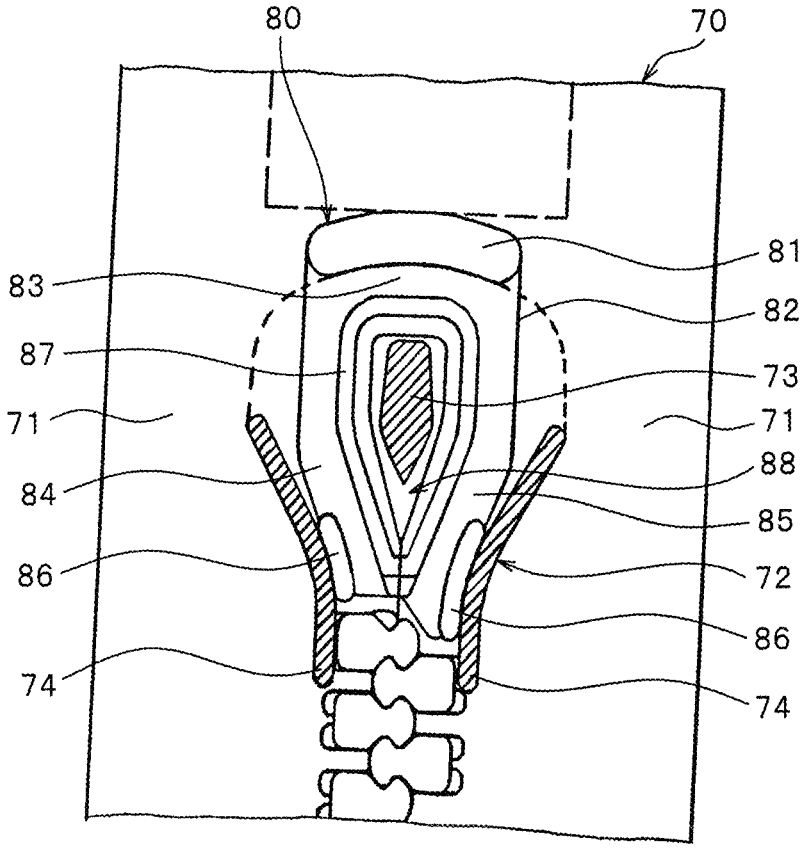
FIG. 9 is a partial cross-sectional view partially cut away to illustrate a state that the slider is held at the sliding limit position on the closing side in a conventional waterproof slide fastener.

Moreover, in the waterproof slide fastener 1 of the present embodiment, when the slider 20 is slid further from the state in which the peripheral surface of the rear end part of the guide column 24 in the slider 20 is in contact with the right and left insertion leg portions 35*a*, 35*b* as shown in FIG. 6 toward the separating direction of the element rows 12 as shown in FIG. 7, the right and left insertion leg portions 35*a*, 35*b* of the first stopper member 30 are moved relatively toward the shoulder mouth side of the slider 20 while being guided by the guide column 24 of the slider 20.

Thereby, the rear end parts of the right and left insertion leg portions 35*a*, 35*b* are separated from each other, and the right and left rear end parts of the close contact protruded rib portion 38 are separated from each other, thereby, a gap is formed between the rear end parts of the right and left insertion leg portions 35*a*, 35*b*. Further, due to an increase in the sliding distance of the slider 20, the gap gradually enlarges to a size that the guide column 24 of the slider 20 is able to pass through. When the gap is formed between the rear end parts of the right and left insertion leg portions 35*a*, 35*b* as above, the sealed state of the accommodating space portion 39 is released to become the state in which watertightness and airtightness is not exerted.

At this time, the right and left insertion leg portions 35*a*, 35*b* include the inner side curved surfaces 44 disposed continuously toward the insertion base portion 34 side from the inner side press contact surfaces 43 and curving convexly in a plan view as mentioned above. Thereby, when the right and left insertion leg portions 35*a*, 35*b* of the first stopper member 30 are moved relatively toward the shoulder mouth side of the slider 20, the convex inner side curved surfaces 44 of the right and left insertion leg portions 35*a*, 35*b* are in sliding contact with the guide column 24 of the slider 20. This makes it possible to encourage a movement of the insertion leg portions 35*a*, 35*b* such that the insertion leg portions 35*a*, 35*b* are moved toward the shoulder mouth side of the slider 20 while separated so as to rotate outward. As a result, it is expected that the right and left insertion leg portions 35*a*, 35*b* can be easily moved to the shoulder mouth side of the slider 20, and the sliding friction of the slider 20 can be reduced.

REFERENCE SIGNS LIST

1 Waterproof slide fastener
5 Fastener attached product
5*a* Open mouth part
10 Fastener stringer
11 Waterproof tape
12 Element row
13 Fastener element
20 Slider
21 Slider body
22 Upper blade
23 Lower blade
24 Guide column
25 Flange portion
25*a* Upper flange portion
25*b* Lower flange portion
26*a* Rear straight portion
26*b* Curved portion
26*c* Intermediate straight portion
26*d* Shoulder mouth-side tip end portion
27 Boundary position
28 Tab attaching portion
30 First stopper member
31 Thick connecting portion
32 Seal portion
33 Slider insertion portion
34 Insertion base portion
35*a* Left insertion leg portion
35*b* Right insertion leg portion
36*a*,36*b* Leg piece main body portion
37*a*,37*b* Press contact bulged portion
38 Close contact protruded rib portion
39 Accommodating space portion
41 Flange press contact surface (Flange press contact part)
41*a* First press contact straight portion
41*b* Press contact curved portion
41*c* Second press contact straight portion
43 Inner side press contact surface (Inner side press contact part)
44 Inner side curved surface
45 Movement allowing gap
46 Center press contact part
47 Left outer side press contact part
48 Right outer side press contact part
50 Second stopper member
51 Main body portion
52 Extending portion
L1 Length dimension of rear press contact region in the center press contact part
L2 Length dimension of the rear press contact region in left outer side press contact part
L3 Length dimension of the rear press contact region in right outer side press contact part
L4 Minimum length dimension of the movement allowing gap
L5 Length dimension of the rear straight portion in the flange portion
L6 Minimum length dimension between front end edges of upper and lower blades and inner wall surface of the close contact protruded rib portion
L7 Length dimension of front press contact region in right and left outer side press contact parts
D Difference between length dimensions L1, L2 and length dimension L5

The invention claimed is:

1. A waterproof slide fastener at least including:

a right and left pair of fastener stringers in which element rows are provided at tape side edge parts of waterproof tapes;

a slider sliding along the element rows; and a slider stopper member disposed adjacently to end parts of the element rows on a closing direction side, in which the slider includes an upper blade, a lower blade, a guide column connecting the upper blade and the lower blade, and flange portions disposed at right and left side edge parts of the upper blade and the lower blade, the flange portion includes a straight portion extending linearly along a slider sliding direction from a rear mouth of the slider and a curved portion extending to curve outward from an end part of the straight portion, the slider stopper member includes an insertion base portion disposed across the right and left pair of fastener stringers and inserted between the upper blade and the lower blade of the slider, right and left insertion leg portions extending toward the element rows from the insertion base portion, right and left flange press contact portions disposed on outer side surfaces of tip end parts of the insertion leg portions to be in press contact with the flange portions, and blade close contact portions in close contact with inner surfaces of the upper blade and the lower blade, wherein the right and left flange press contact portions respectively include a press contact curved portion curving corresponding to the curved portion of the flange portions in the slider and a press contact straight portion extending linearly along the slider sliding direction from a rear mouth side end part of the press contact curved portion toward the rear mouth, wherein in a state that the slider is held at a sliding limit position on a closing direction side, a center press contact part in which the right and left insertion leg portions of the slider stopper member are in press contact with each other and right and left tip end parts of the blade close contact portions are in press contact with each other, and right and left outer side press contact parts in which the flange press contact portions of the slider stopper member are in press contact with the flange portions are formed, and the center press contact part and the right and left outer side press contact parts include rear press contact regions extending to a rear mouth side of the slider from a boundary position between the straight portion and the curved portion of the flange portion in a slider sliding direction.

2. The waterproof slide fastener according to claim 1, wherein a length dimension in a slider sliding direction of the rear press contact region in the center press contact part and a length dimension in a slider sliding direction of the rear press contact region in at least one of the right and left outer side press contact parts are set to be smaller than a length dimension in a slider sliding direction of the straight portion in the flange portion.

3. The waterproof slide fastener according to claim 2, wherein the length dimension of the rear press contact region in the center press contact part and the length dimension of the rear press contact region in one of the right and left outer side press contact parts are set to be smaller than the length dimension of the rear press contact region in the other of right and left outer side press contact parts.

4. The waterproof slide fastener according to claim 2, wherein a difference between the length dimension of the rear press contact region in the center press contact part and the length dimension of the straight portion in the flange portion, and a difference between the length dimension of the rear press contact region in one of the right and left outer side press contact parts and the length dimension of the straight portion in the flange portion is set to be larger than ⅓ of a maximum length dimension of a fastener element in the element rows in a slider sliding direction.

5. The waterproof slide fastener according to claim 1, wherein in a state that the slider is held at a sliding limit position on a closing direction side, a movement allowing gap is formed between a peripheral surface on the rear mouth side end part of the guide column in the slider and inner peripheral surfaces of the insertion leg portions disposed behind the peripheral surface on the rear mouth side end part, length dimensions in a slider sliding direction of each of the rear press contact regions in the center press contact part and the right and left outer side press contact parts are set to be larger than a minimum length dimension of the movement allowing gap in a slider sliding direction.

6. The waterproof slide fastener according to claim 1, wherein the blade close contact portions are formed of protruded rib portions protruding continuously on both top and back surfaces of the insertion base portion and the right and left insertion leg portions at inner side edge parts, and when a cross section orthogonal to a tape top and back direction is viewed in a state that a right and left outer side press contact parts are in press contact with the flange portions, the protruded rib portions surround the guide column of the slider and keep an inside region of the protruded rib portions in a sealed state.

7. A waterproof slide fastener at least including:

a right and left pair of fastener stringers in which element rows are provided at tape side edge parts of waterproof tapes;

a slider sliding along the element rows; and a slider stopper member disposed adjacently to end parts of the element rows on a closing direction side, in which the slider includes an upper blade, a lower blade, a guide column connecting the upper blade and the lower blade, and flange portions disposed at right and left side edge parts of the upper blade and the lower blade, the slider stopper member includes an insertion base portion disposed across the right and left pair of fastener stringers and inserted between the upper blade and the lower blade of the slider, right and left insertion leg portions extending toward the element rows from the insertion base portion, right and left flange press contact portions disposed on outer side surfaces of tip end parts of the insertion leg portions to be in press contact with the flange portions, and blade close contact portions in close contact with inner surfaces of the upper blade and the lower blade, wherein in a state that the slider is held at a sliding limit position on a closing direction side, a center press contact part in which the right and left insertion leg portions of the slider stopper member are in press contact with each other and right and left tip end parts of the blade close contact portions are in press contact with each other is formed, and the center press contact part is maintained even in a state that the slider is moved from the sliding limit position, the guide column of the slider is separated from the insertion base portion of the slider stopper member, and the blade close contact portions are held at a position in close contact with the upper blade and the lower blade of the slider.

8. The waterproof slide fastener according to claim 7, wherein the flange portion includes a straight portion extending linearly along a slider sliding direction from a rear mouth of the slider and a curved portion extending to curve outward from an end part of the straight portion, the right and left flange press contact portions respectively include a press contact curved portion curving corresponding to the curved portion of the flange portions in the slider and a press contact straight portion extending linearly along the slider sliding direction from a rear mouth side end part of the press contact curved portion toward the rear mouth, in a state that the slider is held at the sliding limit position, right and left outer side press contact parts in which the flange press contact portions of the slider stopper member are in press contact with the flange portions are formed, and the center press contact part and the right and left outer side press contact parts include rear press contact regions extending to a rear mouth side of the slider from a boundary position between the straight portion and the curved portion of the flange portion in a slider sliding direction.

9. The waterproof slide fastener according to claim 8, wherein a length dimension in a slider sliding direction of the rear press contact region in the center press contact part and a length dimension in a slider sliding direction of the rear press contact region in at least one of the right and left outer side press contact parts are set to be smaller than a length dimension in a slider sliding direction of the straight portion in the flange portion.

10. The waterproof slide fastener according to claim 8, wherein in a state that the slider is held at a sliding limit position on a closing direction side, a movement allowing gap is formed between a peripheral surface on the rear mouth side end part of the guide column in the slider and inner peripheral surfaces of the insertion leg portions disposed behind the peripheral surface on the rear mouth side end part, length dimensions in a slider sliding direction of each of the rear press contact regions in the center press contact part and the right and left outer side press contact parts are set to be larger than a minimum length dimension of the movement allowing gap in a slider sliding direction.

11. The waterproof slide fastener according to claim 9, wherein the length dimension of the rear press contact region in the center press contact part and the length dimension of the rear press contact region in one of the right and left outer side press contact parts are set to be smaller than the length dimension of the rear press contact region in the other of right and left outer side press contact parts.

12. The waterproof slide fastener according to claim 9, wherein a difference between the length dimension of the rear press contact region in the center press contact part and the length dimension of the straight portion in the flange portion, and a difference between the length dimension of the rear press contact region in one of the right and left outer side press contact parts and the length dimension of the straight portion in the flange portion is set to be larger than ⅓ of a maximum length dimension of a fastener element in the element rows in a slider sliding direction.

13. The waterproof slide fastener according to claim 7, wherein the blade close contact portions are formed of protruded rib portions protruding continuously on both top and back surfaces of the insertion base portion and the right and left insertion leg portions at inner side edge parts, and when a cross section orthogonal to a tape top and back direction is viewed in a state that a right and left outer side press contact parts are in press contact with the flange portions, the protruded rib portions surround the guide column of the slider and keep an inside region of the protruded rib portions in a sealed state.

* * * * *